US007366435B2

(12) United States Patent
Nagatsuma et al.

(10) Patent No.: US 7,366,435 B2
(45) Date of Patent: Apr. 29, 2008

(54) FIXING CONTROLLER, IMAGE FORMING APPARATUS, AND FIXING CONTROL METHOD

(75) Inventors: Tohru Nagatsuma, Kanagawa (JP); Hiroyuki Takahashi, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 63 days.

(21) Appl. No.: 10/923,009

(22) Filed: Aug. 23, 2004

(65) Prior Publication Data

US 2005/0047810 A1 Mar. 3, 2005

(30) Foreign Application Priority Data

Aug. 25, 2003 (JP) ..... 2003-299617
Aug. 25, 2003 (JP) ..... 2003-299618
Jun. 22, 2004 (JP) ..... 2004-183474

(51) Int. Cl.
*G03G 15/20* (2006.01)

(52) U.S. Cl. ..... 399/69; 399/328; 219/216

(58) Field of Classification Search ..... 399/69, 399/328; 219/216
See application file for complete search history.

(56) References Cited

U.S. PATENT DOCUMENTS 5,347,372 A 9/1994 Aihara et al.
5,365,314 A * 11/1994 Okuda et al. ..... 399/69
5,557,707 A 9/1996 Hayashi et al.
5,598,279 A 1/1997 Hayashi et al.
6,321,046 B1 11/2001 Kikuchi et al.
2002/0005405 A1* 1/2002 Sato et al. ..... 219/619
2002/0067928 A1 6/2002 Nakayama
2002/0116144 A1 8/2002 Yamauchi et al.
2003/0086718 A1* 5/2003 Birumachi ..... 399/69
2003/0219271 A1 11/2003 Kinouchi et al.
2004/0005163 A1 1/2004 Miura et al.
2005/0058467 A1* 3/2005 Sasamoto et al. ..... 399/67

FOREIGN PATENT DOCUMENTS

EP 1 403 740 A1 3/2004
JP 2001-175118 6/2001
JP 2002-174982 6/2002
JP 3400402 2/2003

* cited by examiner

*Primary Examiner*—David M. Gray
*Assistant Examiner*—Ryan D. Walsh
(74) *Attorney, Agent, or Firm*—Oblon, Spivak, McClelland, Maier & Neustadt, P.C.

(57) ABSTRACT

A fixing controller that utilizes an induction-heating (IH) fixing technique and a 2-CPU fixing technique is provided to reduce the control workload on the main CPU, and to perform a fine control operation, taking advantage of the temperature flexibility that is naturally achieved by the IH fixing technique. In this fixing controller utilizing the IH fixing technique and the 2-CPU fixing technique, the main CPU that controls an entire image forming apparatus only transmits a power control signal as a control instruction to the IH CPU in an IH control circuit. Accordingly, in this fixing controller, IH control is performed by the IH CPU.

19 Claims, 19 Drawing Sheets

| DETECTED TEMP. Ts | PRIMARY CONTROL TEMP. |
|---|---|
| T2 ≦ Ts | Tn |
| T1 ≦ Ts < T2 | Tm |
| T0 ≦ Ts < T1 | Te |
| Ts < T0 | Te |

250

FIXING CONTROLLER, IMAGE FORMING APPARATUS, AND FIXING CONTROL METHOD

BACKGROUND OF THE INVENTION

1. Field of the Invention

The present invention relates to a fixing controller for an induction-heating fixing device, an electrophotographic image forming apparatus, such as a copying machine, a printer, or a facsimiles machine, that is equipped with the fixing controller, and a fixing control method.

2. Description of the Related Art

In an image forming apparatus of the above mentioned type, a heat-roller fixing device is normally employed. In a heat-roller fixing device, each paper sheet having an unfixed toner image formed thereon passes through between a heating fixing roller and a pressure roller. The fixing roller and the pressure roller heat and press the unfixed toner image, thereby fixing it onto the paper sheet.

Such a heat-roller fixing device is normally equipped with a halogen lamp as a heater in the fixing roller, and the halogen lamp heats the inside of the fixing roller.

With such a heating technique utilizing a halogen lamp or the like, however, a long period of time is needed to heat the fixing roller to a required temperature, and heat loss in the heater is also large. In view of this, there has been a strong demand for an efficient fixing device with a short warm-up time.

Meanwhile, an induction-heating (hereinafter also referred to as "IH") fixing device can heat a fixing roller instantly with an eddy current through electromagnetic induction, and the warm-up time can be dramatically shortened. Such an IH fixing device is disclosed in Japanese Laid-Open Patent Application No. 2001-175118 (hereinafter referred to as Patent Document 1), for example.

However, the IH fixing technique requires a fine control operation, because the temperature rising speed is much higher than that of the halogen-heater fixing technique. As a result, the control workload on the central processing unit (CPU) that performs the entire control operation becomes very large. Conventionally, the CPU that controls an entire image forming apparatus also serves as the IH controller. With such a structure, there are problems in that the high-performance CPU leads to a cost increase and the control software becomes very complicated (with a higher probability of bugs). If a regular CPU is employed to avoid those problems and to simplify the IH control operation, however, another problem is caused with the insufficient induction-heating control.

So as to counter those problems, Japanese Patent Publication No. 3400402 (Patent Document 2) discloses a 2-CPU fixing technique. By this 2-CPU fixing technique, a CPU is mounted in an induction-heating control circuit, and this CPU is independent of the CPU that controls the entire image forming apparatus.

By the technique disclosed in Patent Document 2, however, the CPU of the main control circuit controls the CPU of the induction-heating control circuit, using a power control signal and a heating ON/OFF signal. In such a structure, the workload on the CPU of the main control circuit cannot be sufficiently reduced. More specifically, the CPU of the main control circuit in this structure needs to perform arithmetic operations for the power control signal and the heating ON/OFF signal, based on the temperature of the fixing unit detected by a thermistor. In this structure, the CPU of the induction-heating control circuit merely serves as a mediator between the CPU of the main control circuit and the inverter circuit. Therefore, the workload on the CPU of the main control circuit cannot be sufficiently reduced, and the control software cannot be prevented from becoming complicated.

With the 2-CPU fixing technique, on the other hand, the CPU of the induction-heating control circuit directly performs power control on the excitation coil. In doing so, it is necessary to take safety measures against a runaway condition in the CPU of the induction-heating control circuit. In the prior art, however, this aspect is not taken into consideration at all. Since the IH fixing technique involves very rapid temperature rises, there is a greater danger than in a halogen-lamp fixing operation, for example, of the CPU of the IH control circuit going into a runaway condition. Therefore, it is very important to take appropriate safety measures. Japanese Laid-Open Patent Application No. 2002-174982 (Patent Document 3) discloses a method of forcibly cutting off the high-frequency current supply, utilizing a temperature detection signal that indicates a temperature error caused in a CPU runaway condition. However, this method merely employs a conventional temperature error detecting technique, and a runaway condition in the CPU is not actually detected by the method. As a result, a time lag is caused, and prompt measures cannot be taken against a runaway condition.

SUMMARY OF THE INVENTION

A general object of the present invention is to provide a fixing controller, an image forming apparatus, and a fixing control method in which the above disadvantages are eliminated.

A more specific object of the present invention is to perform a fine control operation utilizing an induction-heating (IH) fixing technique and a 2-CPU fixing technique that can reduce the control workload on the main CPU and take advantage of the excellent temperature flexibility that is normally obtained by the IH fixing technique.

Another specific object of the present invention is to promptly take safety measures when a runaway condition is detected in the induction-heating CPU.

The above objects of the present invention are achieved by a fixing controller that includes: a main control circuit that includes a main central processing unit for controlling all operations of an image forming apparatus; a temperature sensor that detects a temperature of a heated fixing member; an excitation coil that receives a current supply and inductively heats the heated fixing member; and an induction-heating control circuit that includes a sub central processing unit independent of the main central processing unit, and controls the current supply to the excitation coil, wherein the main central processing unit outputs only a power control signal as a control instruction to the sub central processing unit, based on the temperature detected by the temperature sensor.

As a 2-CPU fixing controller having the sub central processing unit designed especially for induction-heating (IH) control operations, as well as the main central processing unit, this fixing controller can reduce the workload on the main CPU, and perform a fine IH control operation, taking advantage of the excellent temperature flexibility that is naturally obtained by the IH fixing technique. Also, as the control instruction from the main central processing unit to the sub central processing unit only includes a power control signal, the control operation to be performed by the main central processing unit is greatly simplified. Accordingly, the workload on the main central processing unit can be reduced, and the corresponding control software can be prevented from becoming complicated.

The above objects of the present invention are also achieved by a fixing controller that includes: a main control circuit that includes a main central processing unit for controlling all operations of an image forming apparatus; a temperature sensor that detects a temperature of a heated fixing member; an excitation coil that receives a current supply and inductively heats the heated fixing member; and an induction-heating control circuit that includes a sub central processing unit independent of the main central processing unit, and controls the current supply to the excitation coil, wherein the main central processing unit, which receives the temperature of the heated fixing member detected by the temperature sensor, is connected to the sub central processing unit with a signal line for transmitting a power control signal, and the main central processing unit outputs only the power control signal as a control instruction to the sub central processing unit.

As a 2-CPU type fixing controller having the sub central processing unit designed especially for IH control operations, as well as the main central processing unit, this fixing controller can reduce the workload on the main CPU, and perform a fine IH control operation, taking advantage of the excellent temperature flexibility that is naturally obtained by the IH fixing technique. Also, as the control instruction from the main central processing unit to the sub central processing unit only includes a power control signal to be transmitted via a signal line, the control operation to be performed by the main central processing unit is greatly simplified. Accordingly, the workload on the main central processing unit can be reduced, and the corresponding control software can be prevented from becoming complicated.

In the above fixing controller, the sub central processing unit may have a lower processing capacity than the main central processing unit.

Since the sub central processing unit is only required to perform IH control operations, a one-chip CPU that is inexpensive and has a relatively low processing capacity can be employed. Unlike the main central processing unit, the sub central processing unit does not need to perform other control operations, and accordingly, can perform a fine IH control operation.

In the above fixing controller, the power control signal output from the main central processing unit may be a serial signal.

As the power control signal is a serial signal, the total number of signals can be reduced.

In the above fixing controller, the serial signal may be a PWM signal with a predetermined cycle.

With the PWM signal, a serial-signal fixing method can be easily realized.

In the above fixing controller, the power control signal output from the main central processing unit may represent a power control level through a combination of bits.

As the power control signal represents a power control level through a combination of bits, the power control level setting process can be further simplified.

In the above fixing controller, the sub central processing unit may calculate a power control level, based on the power control signal from the main central processing unit, a sensed current of the excitation coil, and a sensed supply voltage. Here, the calculated power control level is used to control the driving power for the excitation coil.

With this structure, a power control level can be correctly calculated in the sub central processing unit that receives only the power control signal from the main central processing unit. Using the calculated power control level, the sub central processing unit can control the driving power for the excitation coil.

In the above fixing controller, the main central processing unit may periodically acquire the temperature of the heated fixing member from the temperature sensor, and, in accordance with the temperature acquired, may periodically output a target temperature signal to the sub central processing unit.

In this structure, the main central processing unit, which controls the entire image forming operation, directly monitors the temperature of the heated fixing member, and, in accordance with the monitored temperature, controls the sub central processing unit only through a power control signal, when necessary, in such a manner that the optimum output of the excitation coil can be obtained. Accordingly, a fine fixing control operation that is suitable for the detected temperature and the operating state of the image forming apparatus can be constantly performed, and higher image quality can be achieved.

In the above fixing controller, the main central processing unit may periodically acquire the temperature of the heated fixing member detected by the temperature sensor, and, in accordance with the temperature, may switch output cycles of the power control signal to be output to the sub central processing unit.

In this structure, the main central processing unit periodically acquires the temperature of the heated fixing member, and, in accordance with the temperature, switches the output cycles of the power control signal to be output to the sub central processing unit. Accordingly, the main central processing unit only needs to perform power control in a short cycle at such a temperature as to require a fine control operation. The main central processing unit performs power control in a long cycle at such a temperature as not to require a fine control operation. Thus, the workload on the main central processing unit can be reduced.

In the above fixing controller, when the temperature acquired is close to a target temperature, the main central processing unit may output the power control signal in a relatively short cycle, and, when the temperature acquired is far from the target temperature, the main central processing unit may output the power control signal in a relatively long cycle.

Accordingly, the main central processing unit outputs a power control signal in a relatively short cycle when the temperature acquired from the temperature sensor is close to the target temperature. The main central processing unit outputs a power control signal in a relatively long cycle when the temperature acquired from the temperature sensor is far from the target temperature. Thus, the workload on the main central processing unit can be reduced.

In the above fixing controller, when the temperature acquired is close to a target temperature, the main central processing unit may acquire the temperature from the temperature sensor in a relatively short cycle and output a relatively minute power control signal, and, when the temperature acquired is far from the target temperature, the main central processing unit may acquire the temperature from the temperature sensor in a relatively long cycle and output a relatively rough power control signal.

Accordingly, when the temperature acquired from the temperature sensor is close to the target temperature, the main central processing unit acquires the temperature from the temperature sensor in a relatively short cycle and outputs a relatively minute power control signal. When the temperature acquired from the temperature sensor is far from the target temperature, the main central processing unit acquires the temperature from the temperature sensor in a relatively long cycle and outputs a relatively rough power control signal. Thus, a fine IH control operation can be performed, while the workload on the main central processing unit is reduced.

The above fixing controller may further include a table that defines the output cycles of the power control signal to be output to the sub central processing unit. In this table, each of the signal output cycles is associated with a temperature value. In accordance with the temperature acquired from the temperature sensor, the main central processing unit refers to the table and switches the output cycles of the power control signal to be output to the sub central processing unit.

With this structure, the main central processing unit can switch the output cycles not only between the short cycle and the long cycle, but also according to the table.

In the above fixing controller, the main central processing unit may have power control signal patterns that are preset therein. The power control signal patterns vary with the fixing characteristics of each of different machines (image forming apparatuses).

Image forming apparatuses of different machine types are different from one another in fixing characteristics such as toner characteristics. In the above structure, however, a power control signal pattern is set for each machine type, so that a fine fixing control operation using a power control signal can be performed, with the fixing characteristics of each machine type being taken into consideration. Accordingly, the fixing starting time can be shortened in a suitable manner for each machine type. Here, the power control signal patterns set in the main central processing unit are simply changed according to the machine type, because only the power control signal is involved in the fixing control operation. Therefore, it is not necessary to modify the sub central processing unit according to the machine type, and the sub central processing unit can be used for any image forming apparatus.

In the above fixing controller, the fixing characteristics may be the toner characteristics of each machine.

With the toner characteristics being taken into consideration in a fixing control operation, the power control signal patterns are simply changed, when there is a change in the toner characteristics. Thus, the fixing starting time can be shortened in a suitable manner for the machine type.

In the above fixing controller, the toner characteristics may include the warm-up characteristics, the temperature rising characteristics, and the fixing unit characteristics of the machine.

With the warm-up characteristics, the temperature rising characteristics, and the fixing unit characteristics as the toner characteristics being taken into consideration in a fixing control operation, the power control signal patterns are simply changed when there is a change in the toner characteristics. Thus, the fixing starting time can be shortened in a suitable manner for the machine type.

In the above fixing controller, the sub central processing unit has a shorter control cycle for the power control signal than the main central processing unit.

As the control cycle for the power control signal in the sub central processing unit is shorter than the control cycle in the main central processing unit, the control cycle in the sub central processing unit does not lag behind the control cycle in the main processing unit. Accordingly, the sub central processing unit constantly maintains sufficiently high resolution for a fine control operation. Thus, a fine IH control operation can be performed, taking advantage of the excellent temperature flexibility that is naturally obtained by the IH fixing technique.

In the above fixing controller, the main central processing unit may renew the power control signal to be output to the sub central processing unit at flexible intervals of "control cycle"×n (n being an integer).

In the structure with sufficiently high resolution for a fine control operation, the power control signal to be output from the main central processing unit to the sub central processing unit is renewed at flexible intervals. In this manner, the power control signal is renewed in a short cycle only when necessary. At other times, the power control signal is renewed in a long cycle. Thus, a fine IH control operation can be performed, while the control load on the main central processing unit is reduced.

In the above fixing controller, the main central processing unit may be able to arbitrarily set the renewal cycle of the power control signal to be output to the sub central processing unit in accordance with the temperature acquired from the temperature sensor.

In this structure, the renewal cycle of the power control signal can be arbitrarily set in accordance with the temperature acquired from the temperature sensor. Thus, a fine IH control operation can be constantly performed while the control workload on the main central processing unit is reduced.

The above objects of the present invention are also achieved by a fixing controller that includes: a main control circuit that includes a main central processing unit for controlling all operations of an image forming apparatus; a temperature sensor that detects a temperature of a heated fixing member; an excitation coil that receives a current supply and inductively heats the heated fixing member; and an induction-heating control circuit that includes a sub central processing unit independent of the main central processing unit, and controls the current supply to the excitation coil, wherein the main central processing unit outputs only a temperature control signal as a control instruction to the sub central processing unit, and the sub central processing unit acquires the temperature of the heated fixing member detected by the temperature sensor.

As a 2-CPU type fixing controller having the sub central processing unit designed especially for induction-heating (IH) control operations, as well as the main central processing unit, this fixing controller can reduce the workload on the main CPU, and perform a fine IH control operation, taking advantage of the excellent temperature flexibility that is naturally obtained by the IH fixing technique. Also, as the control instruction from the main central processing unit to the sub central processing unit only includes a temperature control signal, the control operation to be performed by the main central processing unit is greatly simplified. Accordingly, the workload on the main central processing unit can be reduced, and the corresponding control software can be prevented from becoming complicated. Furthermore, the main central processing unit only manages a target temperature in an IH control operation. Thus, the control workload on the main central processing unit can be made even smaller than in the case of using a power control signal.

The above objects of the present invention are also achieved by a fixing controller that includes: a main control circuit that includes a main central processing unit for controlling all operations of an image forming apparatus; a temperature sensor that detects a temperature of a heated fixing member; an excitation coil that receives a current supply and inductively heats the heated fixing member; and an induction-heating control circuit that includes a sub central processing unit independent of the main central processing unit, and controls the current supply to the excitation coil, wherein the main central processing unit is connected to the sub central processing unit with a signal line for transmitting a temperature control signal to the sub central processing unit, which acquires the temperature of the heated fixing member detected by the temperature sensor, the main central processing unit outputs only the temperature control signal as a control instruction to the sub central processing unit, and the sub central processing unit is connected to the temperature sensor.

As a 2-CPU type fixing controller having the sub central processing unit designed especially for induction-heating (IH) control operations, as well as the main central processing unit, this fixing controller can reduce the workload on the main CPU and perform a fine IH control operation, taking advantage of the excellent temperature flexibility that is naturally obtained by the IH fixing technique. Also, as the control instruction from the main central processing unit to the sub central processing unit only includes a temperature control signal, the control operation to be performed by the main central processing unit is greatly simplified. Accordingly, the workload on the main central processing unit can be reduced, and the corresponding control software can be prevented from becoming complicated. Furthermore, the main central processing unit only manages a target temperature in an IH control operation. Thus, the control workload on the main central processing unit can be made even smaller than in the case of using a power control signal.

In the above fixing controller, the sub central processing unit may have a lower processing capacity than the main central processing unit.

Since the sub central processing unit is only required to perform IH control operations, a one-chip CPU that is inexpensive and has a relatively low processing capacity can be employed. Unlike the main central processing unit, the sub central processing unit does not need to perform other control operations, and accordingly, can perform a fine IH control operation.

In the above fixing controller, the temperature control signal output from the main central processing unit may be a serial signal.

As the power control signal is a serial signal, the total number of signals can be reduced.

In the above fixing controller, the serial signal may be a PWM signal with a predetermined cycle.

With a PWM signal, a serial-signal fixing method can be easily realized.

In the above fixing controller, the temperature control signal output from the main central processing unit may represent a temperature control level through a combination of bits.

As the power control signal represents a power control level through a combination of bits, the power control level setting process can be further simplified.

In the above fixing controller, the sub central processing unit may calculate a power control level, based on the temperature control signal from the main central processing unit, a sensed current of the excitation coil, and a sensed supply voltage. Here, the calculated power control level is used to control the driving power for the excitation coil.

With this structure, a power control level can be correctly calculated in the sub central processing unit that receives only a temperature control signal from the main central processing unit. Using the calculated power control level, the sub central processing unit can control the driving power for the excitation coil. Particularly, the sub central processing unit that is in charge of the actual power control directly monitors the temperature of the heated fixing member, and controls the driving power in such a manner that the optimum output can be obtained from the excitation coil. Thus, a finer IH control operation can be performed suitably for the state of the machine, the target temperature in the selected image mode, and the detected temperature.

In the above fixing controller, the main central processing unit may periodically output a target temperature signal as the temperature control signal to the sub central processing unit, may periodically acquire the temperature of the heated fixing member detected by the temperature sensor, and, in accordance with the temperature acquired, may calculate such a power control level that the temperature of the heated fixing member approaches the target temperature. Here, the calculated power control level is used to control the driving power for the excitation coil.

In this structure, the sub central processing unit that is in charge of the actual power control directly monitors the temperature of the heated fixing member. In accordance with the monitored temperature, the sub central processing unit controls the driving power in such a manner that the optimum output can be obtained from the excitation coil. Thus, a finer IH control operation can be performed suitably for the state of the machine, the target temperature in the selected image mode, and the detected temperature.

In the above fixing controller, the main central processing unit may be able to arbitrarily switch the output cycles of the temperature control signal to be output to the sub central processing unit.

Switching the output cycles of the temperature control signal to be output to the sub central processing unit, the main central processing unit controls the power control operation in a short cycle only when a fine control operation is necessary, and controls the power control operation in a long cycle when a fine control operation is not necessary. Since the sub central processing unit is in charge of the IH control operation, the main central processing unit might need to output the temperature control signal only once.

In the above fixing controller, the sub central processing unit may have a shorter control cycle for the temperature control signal than the main central processing unit.

As the control cycle for the temperature control signal in the sub central processing unit is shorter than the control cycle in the main central processing unit, the control cycle in the sub central processing unit does not lag behind the control cycle in the main processing unit. Accordingly, the sub central processing unit constantly maintains sufficiently high resolution for a fine control operation. Thus, a fine IH control operation can be constantly performed, taking advantage of the excellent temperature flexibility that is naturally obtained by the IH fixing technique.

In the above fixing controller, the main central processing unit may renew the temperature control signal to be output to the sub central processing unit at flexible intervals of "control cycle"×n (n being an integer)

In this structure with sufficiently high resolution for a fine control operation, the temperature control signal to be output from the main central processing unit to the sub central processing unit is renewed at flexible intervals. In this manner, the temperature control signal is renewed in a short cycle only when necessary. At other times, the temperature control signal is renewed in a long cycle. Thus, a fine IH control operation can be performed, while the control load on the main central processing unit is reduced.

In the above fixing controller, the main central processing unit may acquire the temperature of the heated fixing member detected by the temperature sensor at the start of current supply, and, in accordance with the temperature acquired, may output a temperature control signal with a different value from a temperature control signal corresponding to a target temperature.

When the temperature of the heated fixing member at the start of current supply is higher than a predetermined reference temperature, and more time can be allowed for the warm-up time, the value of the temperature control signal is set at a lower value than the target temperature value. In this manner, unnecessary power consumption can be reduced. Here, the main central processing unit only needs to output the temperature control signal, and the control workload on the main central processing unit is reduced accordingly.

In the above fixing controller, when the temperature of the heated fixing member acquired from the temperature sensor at the start of current supply is high, the main central processing unit may output a temperature control signal with a lower value than the temperature control signal corresponding to the target temperature.

When the temperature of the heated fixing member at the start of current supply is higher than a predetermined reference temperature, and more time can be allowed for the warm-up time, the value of the temperature control signal is set at a lower value than the target temperature value. In this manner, unnecessary power consumption can be reduced. Here, the main central processing unit only needs to output the temperature control signal, and the control workload on the main central processing unit is reduced accordingly.

In the above fixing controller, the main central processing unit may output a temperature control signal with a different value from the temperature control signal corresponding to the target temperature, so that the heated fixing member has a constant warm-up time.

Although the warm-up time varies with the temperature of the heated fixing member at the start of current supply, there is no point in raising the fixing temperature before the other units are activated. Therefore, the temperature control signal is output in such a manner as to make the warm-up time constant, and the value of the temperature control signal is at first made smaller than the value of the target temperature, depending on the temperature at the start of current supply, for example. Thus, unnecessary power consumption can be reduced.

The above fixing controller may further include a table that defines values of the temperature control signal to be output to the sub central processing unit. In this table, each of the values of the temperature control signal is associated with a temperature value. In accordance with the temperature acquired at the start of current supply, the main central processing unit refers to the table, and switches the values of the power control signal to be output to the sub central processing unit.

With this structure, the main central processing unit can readily output a suitable temperature control signal according to the table.

The above fixing controller may further include: a high-temperature error detecting circuit that detects a high-temperature error in the heated fixing member, based on the temperature acquired from the temperature sensor; and a relay that is provided in a current supply path leading to the excitation coil, and is switched on and off by the high-temperature error detecting circuit. Here, the high-temperature error detecting circuit switches off the relay so as to cut off the current supply to the excitation coil, when a high-temperature error is detected in the heated fixing member.

In this structure, the high-temperature error detecting circuit constantly monitors the heated fixing member to detect a high-temperature error through the hardware, regardless of the control operation performed by the main central processing unit through the software. When a high-temperature error is detected, the relay is switched off, so that the current supply to the excitation coil is promptly cut off. Thus, safety can be maintained and higher reliability can be achieved.

The above fixing controller may further include a relay that is provided in a current supply path leading to the excitation coil, and is switched on and off by the main central processing unit. Here, the main central processing unit switches off the relay so as to cut off the current supply to the excitation coil, when a confirmation signal indicating that the sub central processing unit is operating properly is not transmitted from the sub central processing unit over a predetermined period of time.

In this structure, the main central processing unit constantly monitors the confirmation signal indicating that the sub central processing unit is operation properly. When a runaway condition in the sub central processing unit is directly and quickly detected as the confirmation signal is not transmitted from the sub central processing unit over the predetermined period of time, the relay is switched off, so that the current supply to the excitation coil is promptly cut off. Thus, safety can be maintained and higher reliability can be achieved.

The above fixing controller may further include an alarm unit that signals an error when the relay is switched off.

In this structure, when the relay is switched off due to a high-temperature error or a runaway condition in the sub central processing unit, the alarm unit notifies users of the error. Thus, users can promptly take appropriate measures for the situation, while ensuring safety of the power source.

The above objects of the present invention are also achieved by an image forming apparatus that includes: a printer engine that includes a fixing device equipped with a heated fixing member to be inductively heated, a photosensitive member, and other electrophotographic processing members; and one of the above described fixing controllers that controls the heated fixing member.

Having one of the above described fixing controllers, this image forming apparatus can achieve the same effects as any of the above described fixing controllers.

The above objects of the present invention are also achieved by a fixing control method utilizing a fixing controller that includes: a main control circuit that includes a main central processing unit for controlling all operations of an image forming apparatus; a temperature sensor that detects a temperature of a heated fixing member; an excitation coil that receives a current supply and inductively heats the heated fixing member; and an induction-heating control circuit that includes a sub central processing unit independent of the main central processing unit, and controls the current supply to the excitation coil. This fixing control method includes the steps of: outputting only a power control signal as a control instruction to the sub central processing unit, in accordance with the temperature detected by the temperature sensor; and calculating a power control level based on the power control signal from the main central processing unit, a sensed current of the excitation coil, and a sensed supply voltage, wherein the calculated power control level is used to control the power for driving the excitation coil.

With a 2-CPU fixing control method involving the sub central processing unit designed especially for induction-heating (IH) control operations as well as the main central processing unit, the workload on the main CPU can be reduced, and a fine IH control operation can be performed, taking advantage of the excellent temperature flexibility that is naturally obtained by the IH fixing technique. Also, as the control instruction from the main central processing unit to the sub central processing unit only includes a power control signal, the control operation to be performed by the main central processing unit is greatly simplified. Accordingly, the workload on the main central processing unit can be reduced, and the corresponding control software can be prevented from becoming complicated.

The above objects of the present invention are also achieved by a fixing control method utilizing a fixing controller that includes: a main control circuit that includes a main central processing unit for controlling all operations of an image forming apparatus; a temperature sensor that detects a temperature of a heated fixing member; an excitation coil that receives a current supply and inductively heats the heated fixing member; and an induction-heating control circuit that includes a sub central processing unit independent of the main central processing unit, and controls the current supply to the excitation coil. This method includes the steps of: outputting only a temperature control signal corresponding to a target temperature as a control instruction to the sub central processing unit; and calculating such a power control level as to approach the target temperature, based on the temperature control signal from the main central processing unit, the temperature of the heated fixing member detected by the temperature sensor, a sensed current of the excitation coil, and a sensed supply voltage. Here, the calculated power control level is used to control the power for driving the excitation coil.

For a 2-CPU fixing control method involving the sub central processing unit designed especially for induction-heating (IH) control operations as well as the main central processing unit, the workload on the main CPU can be reduced, and a fine IH control operation can be performed, taking advantage of the excellent temperature flexibility that is naturally obtained by the IH fixing technique. Also, as the control instruction from the main central processing unit to the sub central processing unit only includes a temperature control signal, the control operation to be performed by the main central processing unit is greatly simplified. Accordingly, the workload on the main central processing unit can be reduced, and the corresponding control software can be prevented from becoming complicated. Particularly, the main central processing unit only needs to manage the target temperature in the IH control operation. Thus, the control workload on the main central processing unit can be made smaller than in the case of using a power control signal.

As described above, the present invention provides a structure that utilizes the IH fixing technique and the 2-CPU fixing technique, and causes the main central processing unit to output only a power control signal as a control instruction to the sub central processing unit. Accordingly, the control workload on the main central processing unit can be reduced, and the corresponding control software can be prevented from becoming complicated. Also, a fine control operation can be performed, taking advantage of the temperature flexibility that is naturally obtained by the IH fixing technique.

As described above, the present invention also provides a structure that utilizes the IH fixing technique and the 2-CPU fixing technique, and causes the main central processing unit to output only a temperature control signal as a control instruction to the sub central processing unit. Accordingly, the control workload on the main central processing unit can be reduced, and the corresponding control software can be prevented from becoming complicated. Also, the IH control is performed only by the sub central processing unit. Thus, a fine control operation can be performed, taking advantage of the temperature flexibility that is naturally obtained by the IH fixing technique. Meanwhile, the main central processing unit only needs to manage the target temperature in the IH control operation, and the control workload on the main central processing unit can be made smaller than in the case of using a power control signal.

As described above, the present invention also provides a structure in which the main central processing unit constantly monitors a confirmation signal indicating that the sub central processing unit is operating properly. When a runaway condition in the sub central processing unit is directly and quickly detected as the confirmation signal is not transmitted from the sub central processing unit over a predetermined period of time, the main central processing unit switches off the relay so as to promptly cut off the current supply to the excitation coil. Thus, safety can be secured, and higher reliability can be achieved.

The above and other objects, features, and advantages of the present invention will become more apparent from the following detailed description taken in conjunction with the accompanying drawings.

DESCRIPTION OF THE PREFERRED EMBODIMENTS

The following is a description of preferred embodiments of the present invention, with reference to the accompanying drawings.

First Embodiment

Figure 1:
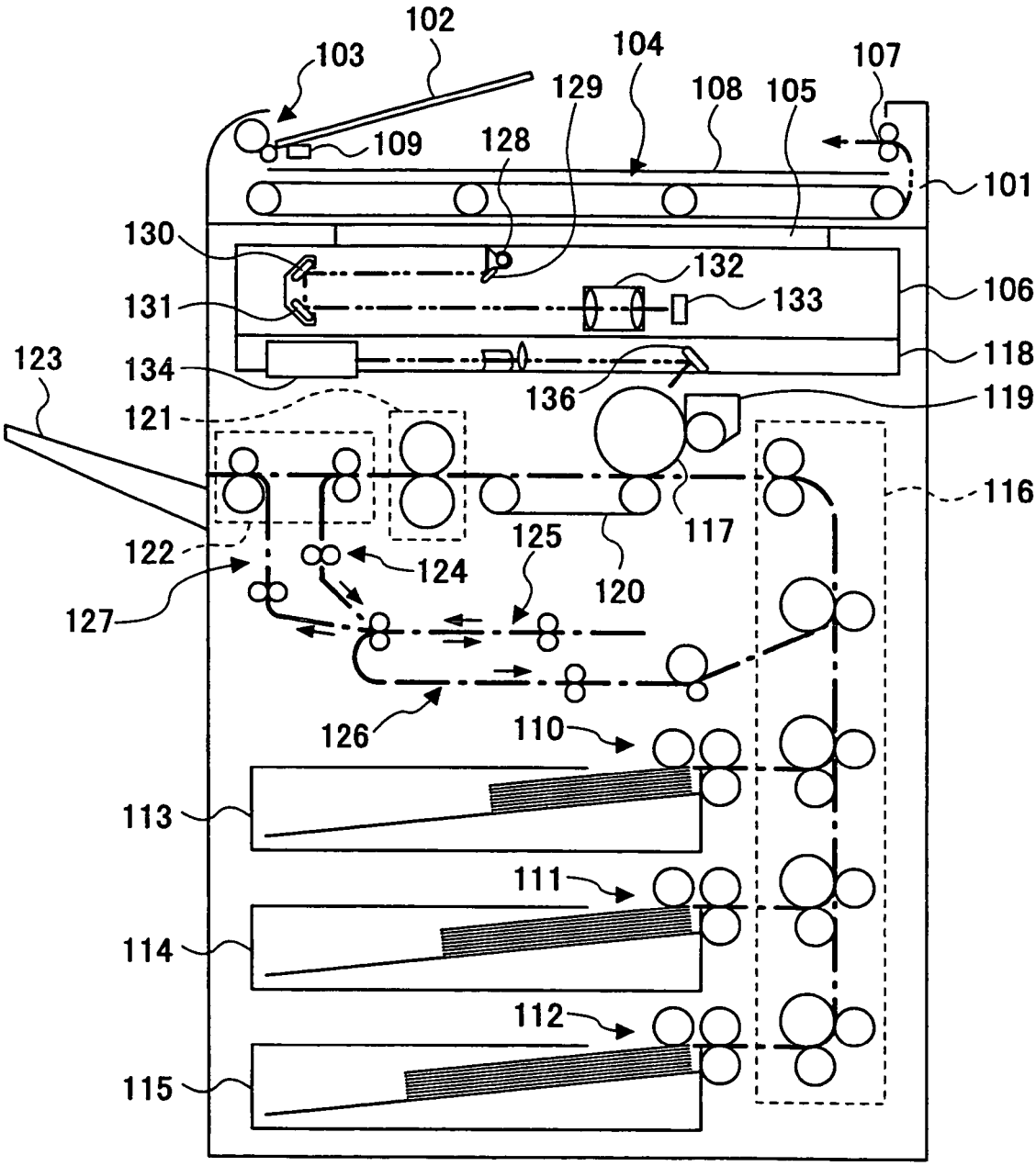
FIG. 1 is a schematic front view of an electrophotographic image forming apparatus to which the present invention is applied.

FIG. 1 is a front view schematically illustrating an electrophotographic image forming apparatus to which the present invention is applied. This image forming apparatus has a printer function and a facsimile function, as well as a copying function. By pressing an application switch key provided in an operations unit, a user can select a desired function mode from the copying function, the printer function, and the facsimile function. When the copying function is selected, the image forming apparatus is set to the copying mode. When the printer function is selected, the image forming apparatus is set to the printer mode. When the facsimile function is selected, the image forming apparatus is set to the facsimile mode.

In the copying mode, the image forming apparatus operates in the following manner. An automatic document feeder (hereinafter referred to as the ADF) 101 has a document tray 102 on which a document is placed, with the side to be copied of each document sheet facing upward. When the start key on the operations unit is pressed, the document sheet at the bottom is transported to a predetermined position on a document table 105 by a sheet feeding roller 103 and a feeder belt 104. The document table is formed with contact glass. The ADF 101 has a counter function that counts the number of document sheets every time a document sheet is fed into the ADF 101. The image information of the document sheet on the document table 105 is read by an image reader 106 as an image input unit. The document sheet is then discharged onto a discharged sheet table 108 by the feeder belt 104 and a discharging roller 107.

If a document set detector 109 detects that there are more document sheets on the document tray 102, the document sheet at the bottom is transported to the predetermined position on the document table 105 by the sheet feeding roller 103 and the feeder belt 104. The image information of the document sheet on the document table 105 is read by the image reader 106. The document sheet is then discharged onto the discharged sheet table 108 by the feeder belt 104 and the discharging roller 107. Here, the sheet feeding roller 103, the feeder belt 104, and the discharging roller 107 are driven by a transporting motor (not shown).

A first sheet feeder 110, a second sheet feeder 111, and a third sheet feeder 112 feed transfer paper sheets as transfer materials stacked on a first tray 113, a second tray 114, and a third tray 115, respectively, when selected. Each of the transfer paper sheets is transported by a vertical transporting unit 116 to a position in contact with a photosensitive member 117. The photosensitive member 117 is a drum-type photosensitive member, and is rotated by a main motor (not shown).

The image data read from the document by the image reader 106 are converted into optical information by a writing unit 118 as means for writing through an image processor (not shown). The photosensitive member 117 is uniformly charged by a charger (not shown), and is then exposed through the optical information supplied from the writing unit 118. As a result, an electrostatic latent image is formed on the photosensitive member 117. The electrostatic latent image on the photosensitive member 117 is developed by a developing device 119 so as to form a toner image.

A transporting belt 120 is transferring means as well as sheet transporting means. When a transfer bias is applied from the power source, the transporting belt 120 transfers the toner image from the photosensitive member 117 onto a transfer paper sheet, while transporting the transfer paper sheet from the vertical transporting unit 116 at the same linear speed as the surface of the photosensitive member 117. The toner image is fixed onto the transfer paper sheet by a fixing device 121, and is then discharged onto a discharged sheet tray 123 by a sheet discharging unit 122. After the toner image transfer, the photosensitive member 117 is cleaned by a cleaning device (not shown). Here, the photosensitive member 117, the charger, the writing unit 118, the developing device 119, and the transferring means constitute a printer engine for forming an image on each transfer paper sheet based on image data.

The above described operation is performed for copying an image on one side of a paper sheet in regular operations mode. When image copying is performed on both sides of a transfer paper sheet in two-side operation mode, a transfer paper sheet is transported from one of the sheet trays 113, 114, and 115, and an image is formed on the transfer paper sheet in the same manner as in the regular operations mode. The sheet discharging unit 122 then transports the transfer paper sheet into a two-side paper transporting path 124, instead of the discharged sheet tray 123. A switchback unit 125 then reverses the transfer paper sheet, and transports the transfer paper sheet to a two-side transporting unit 126.

The two-side transporting unit 126 transports the transfer paper sheet to the vertical transporting unit 116, which in turn transports the transfer paper sheet to the position in contact with the photosensitive member 117. A toner image formed on the photosensitive member 117 in the same manner as described above is transferred onto the back side of the transfer paper sheet. The fixing device 121 then fixes the toner image to complete the two-side copying. The sheet discharging unit 122 discharges the two-side transfer paper sheet onto the discharged sheet tray 123.

The transfer paper sheet reversed by the switchback unit 125 is not transported into the two-side transporting unit 126 this time, and is discharged onto the discharged sheet tray 123 via a reversed sheet transporting path 127.

In the printer mode, image data supplied from the outside, instead of image data supplied from the image processor, are input to the writing unit 118, and an image is formed on a transfer paper sheet by the above described printer engine. In the facsimile mode, image data supplied from the image processor are transmitted to a recipient by a facsimile transmission/reception unit (not shown). Also, image data supplied from a sender are received by the facsimile transmission/reception unit, and are input to the writing unit 118 so that an image is formed on a transfer paper sheet by the above described printer engine.

Figure 2:
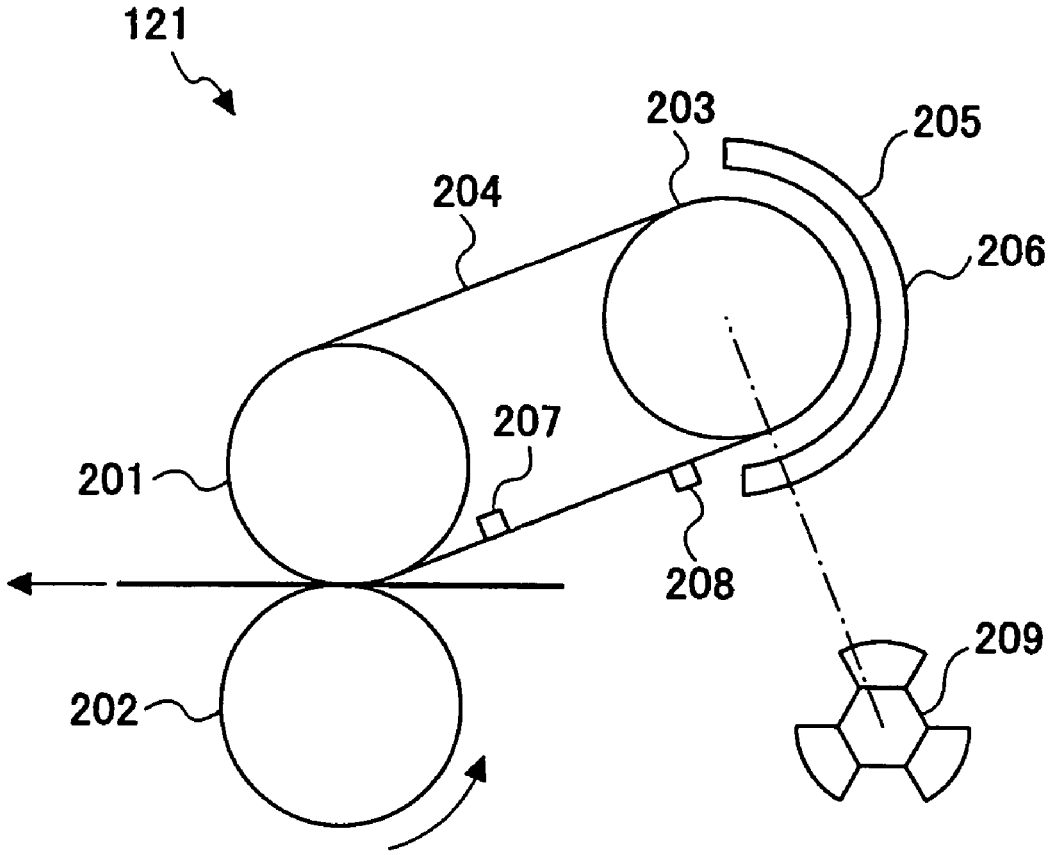
FIG. 2 is a schematic view of the fixing device of the image forming apparatus shown in FIG. 1.

Referring now to FIG. 2, an example structure of the fixing device 121 is described. FIG. 2 is a front view schematically illustrating the structure of the fixing device 121. The fixing device 121 of this embodiment is an induction-heating fixing device. Like a halogen-heating fixing device, the fixing device 121 has a fixing roller 201 and a pressure roller 202 located in the transfer paper transporting path. The fixing roller 201 heats and melts the toner on a transfer paper sheet having a toner image transferred thereon. The pressure roller 202 is situated on the opposite side of the transfer paper transporting path from the fixing roller 201, and puts pressure on the transfer paper sheet so as to fix the toner onto the transfer paper sheet. The fixing device 121 also has a heating roller 203 located at a distance from the fixing roller 201. A fixing belt 204 is provided between the heating roller 203 and the fixing roller 201. The fixing belt 204 is a fixing member to be inductively heated by an excitation coil (hereinafter also referred to as the IH coil) 205, and has a multi-layer structure that includes a heating metal unit (a metal conductor) and non-heat conductive unit. The excitation coil 205 inductively heats the fixing belt 204 with eddy current, and is of an externally heated type in this embodiment. More specifically, the excitation coil 205 has a base 206 of such a shape as to cover almost a half of the outer periphery of the heating roller 203, and wire is coiled around the base 206 in an eddy-like fashion. Current with arbitrary frequency characteristics is applied to the excitation coil 205 by a later described inverter circuit. Receiving magnetic flux generated by the current, the heating roller 203 is heated with the eddy current flowing therein. The heat of the heating roller 203 is transmitted to the fixing belt 204 that is rotationally moving. By virtue of the heat and the nip pressure applied by the fixing roller 201 and the pressure roller 202, the toner placed on a transfer paper sheet moving in the direction of rotation between the fixing roller 201 and the pressure roller 202 is fixed onto the transfer paper sheet.

The temperature of the fixing belt 204 is monitored by a thermistor (a temperature sensor) 207 that is always located in the vicinity. If the temperature of the fixing belt 204 is lower than a predetermined control temperature, the current supply to the IH coil 205 is continued. If the temperature of the fixing belt 204 is higher than the predetermined control temperature, the current supply to the IH coil 205 is suspended. The temperature control is performed by a main control circuit (described later). In a case where the temperature control cannot be performed and the temperature of the fixing belt 204 becomes too high, a thermostat 208 serves as a safety device to cut off the power source.

The fixing roller 201 is rotationally driven by a drive source such as a motor (not shown), and the fixing belt 204 rotationally moves with the driving power. The heating roller 203 is a follower roller that is driven and rotated by the movements of the fixing roller 201 and the fixing belt 204.

On the axle of the heating roller 203, an encoder 209 is provided to function as a sensor for sensing the rotation of the fixing belt 204. If the heating roller 203 is not rotating while the fixing roller 201 is rotating, the encoder 209 determines that the fixing belt 204 is cut off or slipping, and then stops the operation of the inverter circuit so as to prevent a burnout due to a rapid temperature rise in the fixing belt 204 heated by the excitation coil 205.

The induction-heating fixing device 121 is not limited to the externally heated type shown in FIG. 2, but may be of an internally heated type with an excitation coil provided inside the fixing roller 201.

Figure 3:
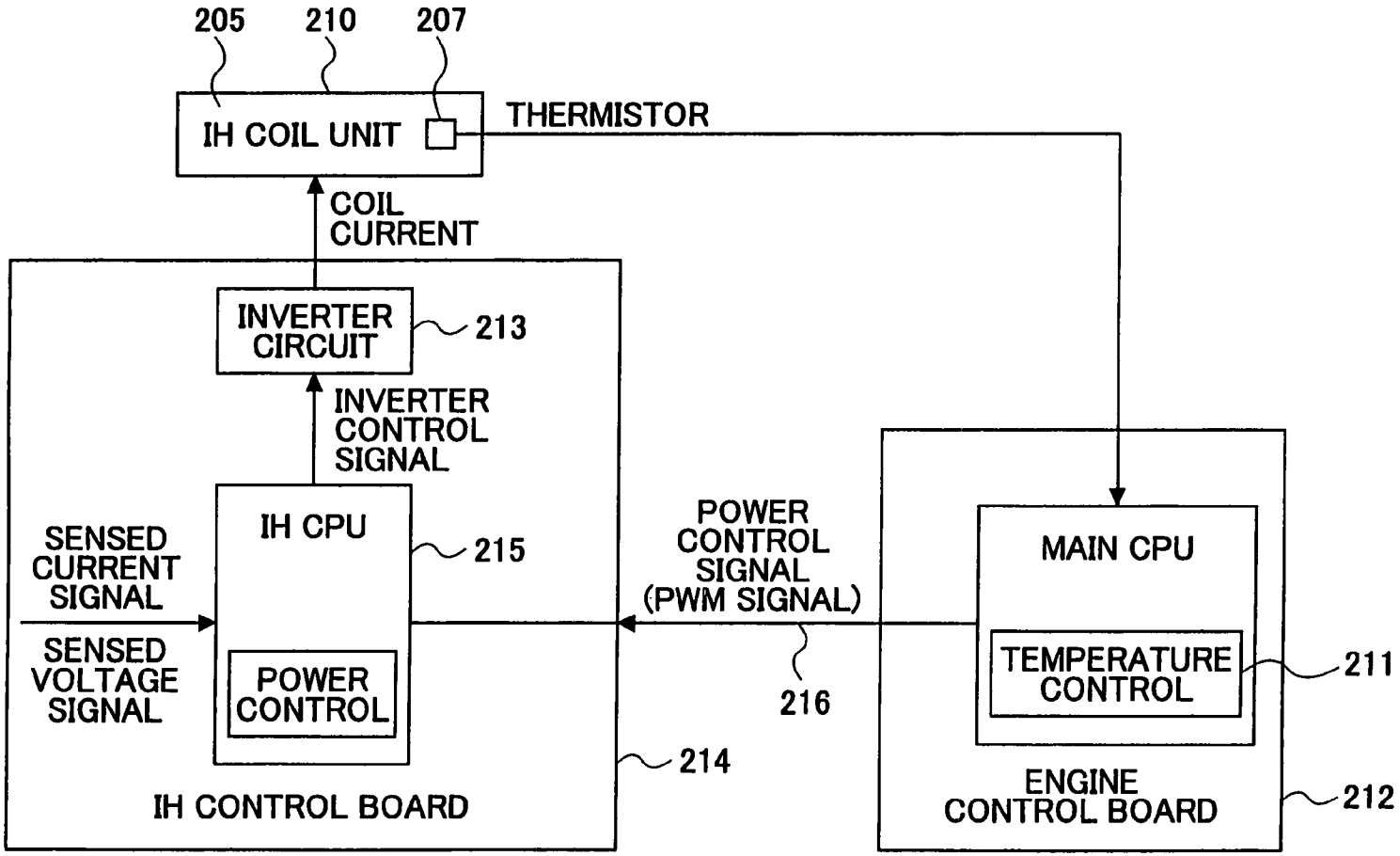
FIG. 3 is a block diagram schematically illustrating the structure of a fixing controller of a first embodiment of the present invention.

Referring now to the block diagram shown in FIG. 3, an example structure of a control system for an IH coil unit 210 that includes the fixing belt 204, the excitation coil 205, and the thermistor 207 is described. The control system, i.e., the fixing controller, has an engine control board (a main control circuit) 212 on which a main CPU 211 is mounted. The main CPU 211 controls the entire image forming apparatus by performing control operations such as drive control for each driving source, peripheral equipment control, electrophotographic process control, and energy savings control, as well as the fixing control of this embodiment. A sensor signal generated from the thermistor 207 that detects the temperature of the fixing belt 204 is input to the main CPU 211. The sensor signal is analog-digital converted by the A-D converter of the main CPU 211, and is used to generate a temperature signal. The main CPU 211 of this embodiment is especially designed to perform the temperature control so that the temperature measured by the thermistor 207 becomes equal to a target temperature in the fixing control operation.

This control system also includes an IH control board (an induction-heating control circuit) 214 on which an inverter circuit 213 is mounted. The inverter circuit 213 functions as a power source for supplying current to the excitation coil 205 that inductively heats the fixing belt 204. After performing full wave rectification on the AC power supply, the inverter circuit 213 supplies a coil current to the excitation coil 205 and a capacitor (not shown). The coil current is a current that is high-frequency switched by a switching control device such as IGBT or FET. With the coil current, resonance is caused, and an AC magnetic field is generated. Accordingly, the fixing belt 204 is heated with eddy current. An IH CPU 215 that serves as a sub central processing unit independent of the main CPU 211 is mounted on the IH control board 214. The IH CPU 215 receives a control instruction only in the form of a power control signal transmitted from the main CPU 211 via a signal line 216. In accordance with the power control signal, a sensed current signal, and a sensed voltage signal, the IH CPU 215 calculates a power control level for the inverter circuit 213, and outputs the power control level as an inverter control signal to the inverter circuit 213. The inverter control signal is used to change the high-frequency switching duty in the inverter circuit 213. In accordance with the inverter control signal, the current flowing in the excitation coil 205 is changed so as to control the heating amount. As the IH CPU 215 of this embodiment performs only the induction-heating control, a one-chip CPU that is less expensive and has a lower processing capacity than the main CPU 211 can be employed as the IH CPU 215. The IH CPU 215 should preferably include an A-D converter, an interval timer, a serial communication UART, and an input/output unit, as well as a built-in ROM.

The IGBT used in the inverter circuit 213 is fragile, and therefore, it is necessary to constantly monitor the incoming current and incoming voltage, so as to prevent the IGBT from breaking down. The sensed current signal and the sensed voltage signal are used for this purpose, and are analog-digital converted by the A-D converter of the IH CPU 215. The converted signals are then processed in the IH CPU 215.

Figure 4A:
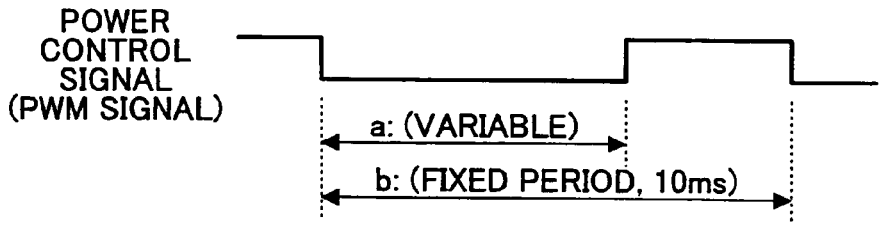
FIGS. 4A through 4D are timing charts illustrating examples of power control signals.
Figure 4B:
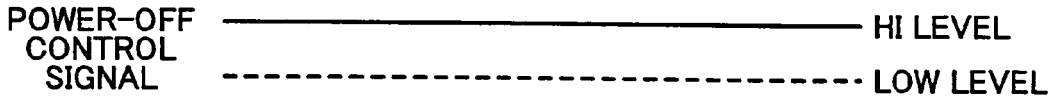
Figure 4C:
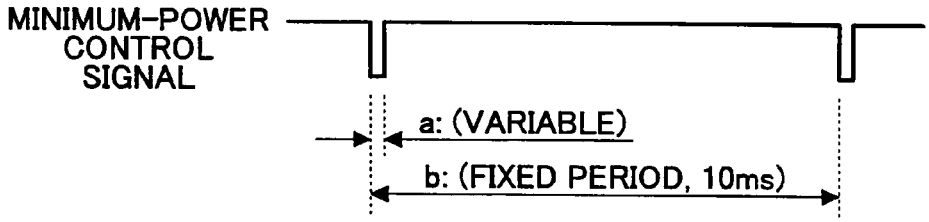
Figure 4D:
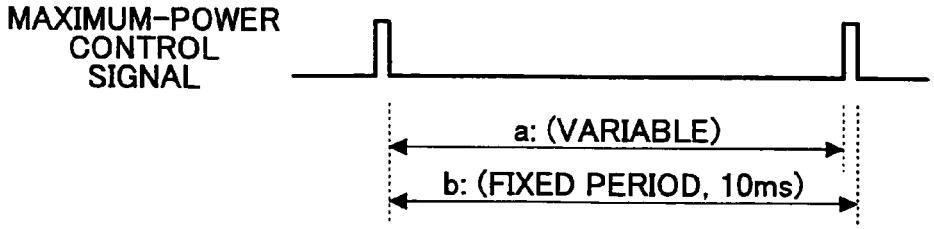

Referring now to the timing charts shown in FIGS. 4A through 4D, an example of the power control signal output from the main CPU 211 to the IH CPU 215 via the signal line 216 is described. In FIGS. 4A through 4D, a serial signal using a PWM (pulse width modulation) signal is shown. The main CPU 211 transmits a PWM signal to the IH CPU 215 at regular intervals of 10 ms, which is shorter than the control cycle (interrupt cycle) of the main CPU 211. The IH CPU 215 should be a CPU that can cope with the 10 ms resolution. In this case, the main CPU 211 does not renew the power control signal (or change the duty of the PWM signal) every 10 ms, but generates the power control signal at flexible intervals of 10 ms×n (n being an integer). In this embodiment, the power control is performed during the variable low level period shown in FIG. 4A. Accordingly, when the power is turned off, the power control signal is fixed at high level, as shown in FIG. 4B. When the low level period has the minimum width in the 10 ms period, as shown in FIG. 4C, the power control signal represents the lowest power level. When the low level period has the maximum width in the 10 ms period, as shown in FIG. 4D, the power control signal represents the highest power level. The minimum width and the maximum width are determined in advance between the main CPU 211 and the IH CPU 215.

The power control signal is not limited to a serial signal (including a PWM signal), but may be a signal that represents a power control level through a combination of bits, such as "111" for 1200 W, "110" for 1100 W, and "101" for 1000 W (see FIG. 2 of Patent Document 2, for example). In this manner, the power control level setting process can be further simplified.

Referring now to the flowcharts shown in

Figure 5A:
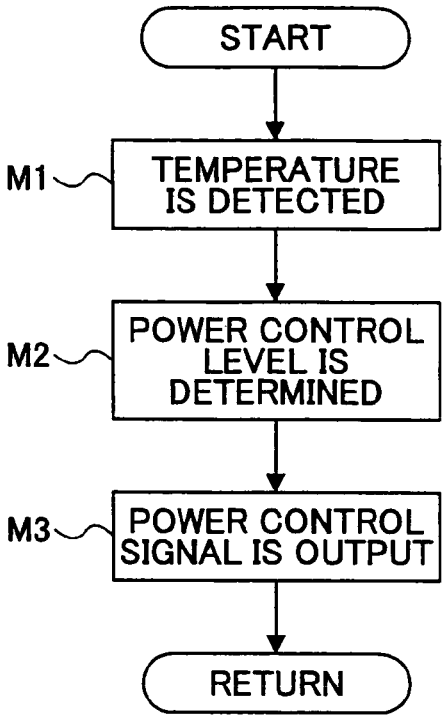
FIGS. 5A and 5B are flowcharts showing the fixing control operation of the first embodiment.
Figure 5B:
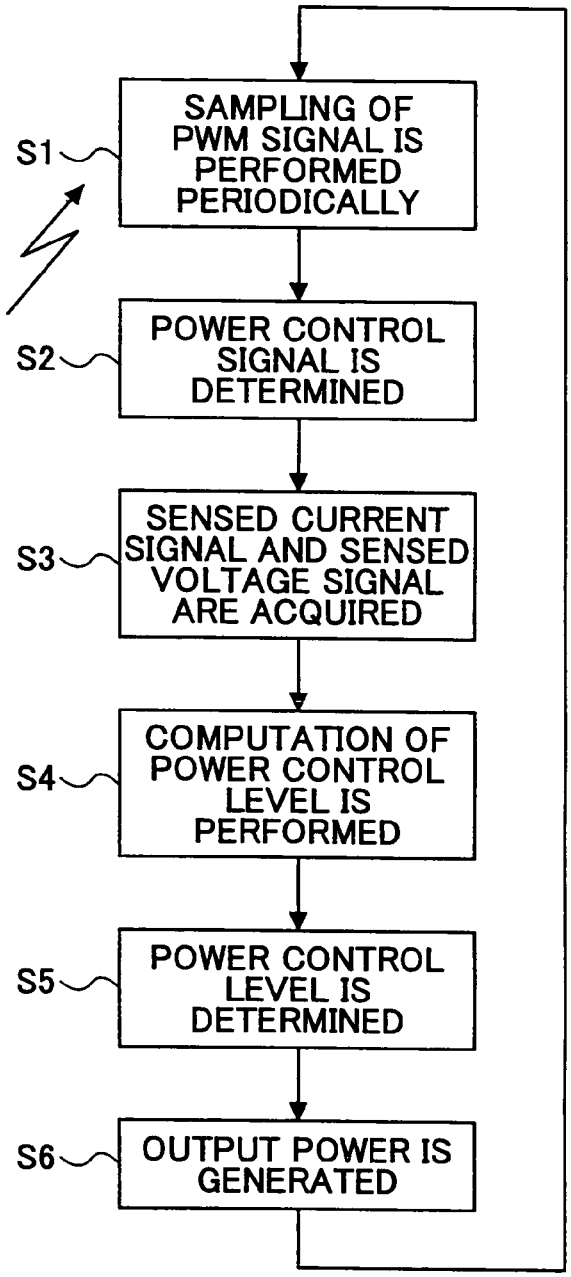

FIGS. 5A and 5B, an example of the fixing control operation is described. In the main routine shown in FIG. 5A, the main CPU 211 first detects the temperature of the fixing belt 204 from the thermistor 207 in step M1. Based on the detected temperature and the target temperature, the main CPU 211 determines the power control level in step M2. In accordance with the power control level, the main CPU 211 determines the duty of the PWM signal, as described with reference to FIGS. 4A through 4D, and outputs the power control signal to the IH CPU 215 via the signal line 216 in step M3.

Meanwhile, the IH CPU 215 periodically performs sampling of the PWM signal supplied from the main CPU 211 at intervals of 10 ms (the control cycle) in step S1, as shown in FIG. 5B. Through the sampling, the IH CPU 215 determines the power control signal in step S2. At the same time, the IH CPU 215 acquires a sensed current signal and a sensed voltage signal in step S3. Based on the power control signal, the sensed current signal, and the sensed voltage signal, the IH CPU 215 performs an arithmetic operation in step S4. Through the arithmetic operation, the IH CPU 215 determines the power control level for the inverter circuit 213 in step S5. Based on the power control value, the IH CPU 215 generates output power in step S6. More specifically, the IH CPU 215 outputs the PWM signal to the inverter circuit 213, and varies the current flowing in the excitation coil 205, depending on the target value.

As described above, this embodiment utilizes the induction-heating fixing technique and the 2-CPU fixing technique, so that the main CPU 211 that controls the entire image forming apparatus only needs to output the power control signal as a control instruction to the IH CPU 215. Accordingly, the control workload on the main CPU 211 can be reduced, and the corresponding control software can be prevented from becoming complicated. Also, a fine control operation can be performed, taking advantage of the excellent temperature flexibility that is naturally obtained by the induction-heating fixing technique. The main CPU 211 that substantially controls the entire image forming operation monitors the temperature of the fixing belt 204 through the thermistor 207. Based on the temperature detection result, the main CPU 211 controls the IH CPU 215 only through the power control signal when necessary, so that the optimum output can be obtained from the excitation coil 205. Thus, a fine fixing control operation can be performed suitably for the detected temperature and the operation mode of the image forming apparatus, and higher image quality can be achieved.

In the control operation example shown in FIGS. 5A and 5B, the main CPU 211 periodically outputs the power control signal at predetermined intervals. However, it is also possible to switch the output cycles of the power control signal in the middle of an operation, as shown in FIGS. 6 and 7.

Figure 6:
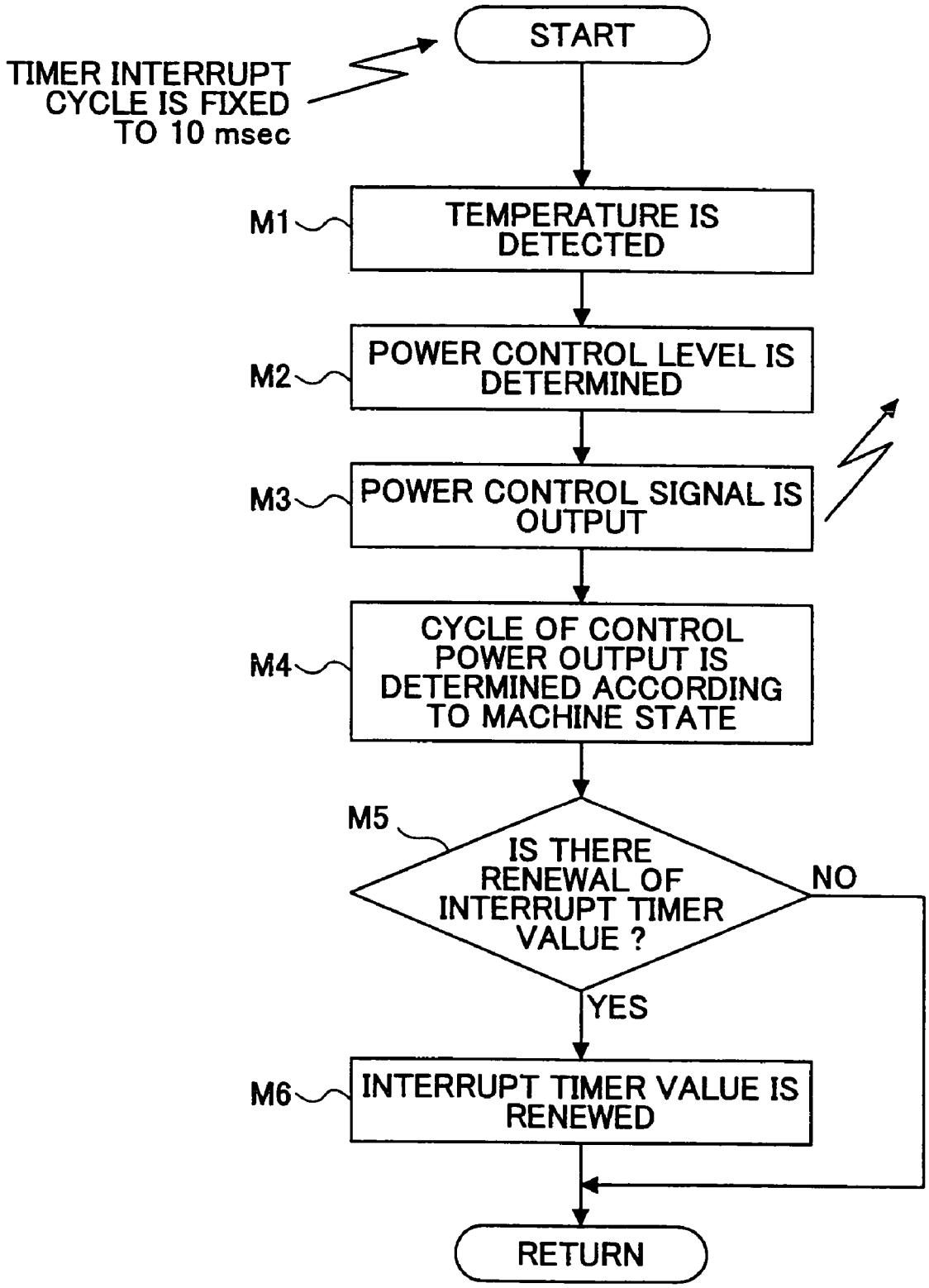
FIG. 6 is a flowchart of an example of the timer-interrupt variable control operation to be performed by the main CPU.

FIG. 6 shows an example of a control operation to be performed by the main CPU 211. In this control operation, the timer interrupt cycle can be varied between 10 ms and 100 ms (by 10 ms increments). After carrying out the procedures of steps M1 through M3 shown in FIG. 5A, the main CPU 211 determines the control cycle (the power control signal output cycle) in accordance with the state of the machine (image forming apparatus) in step M4. Here, the main CPU 211 determines whether fine control is required in accordance with the present state of the machine, and then determines the control cycle to be used until next time. More specifically, the main CPU 211 refers to the temperature information obtained from the thermistor 207. If the temperature is far from the target temperature, as in the case where the machine has just been activated, the main CPU 211 determines such a control cycle as to output the power control signal at relatively long intervals. If the temperature is close to the target temperature, the main CPU 211 determines such a control cycle as to output the power control signal at relatively short intervals for fine control. If the interrupt timer value is not to be renewed ("NO" in step MS), the operation returns to the temperature detecting operation. If the interrupt timer value is to be renewed ("YES" in step M5), the main CPU 211 renews the interrupt timer value in step M6, and the operation returns to the temperature detecting operation. After that, the temperature detecting procedure and the procedures that follow are repeated in the timer interrupt cycle determined by the original timer value or the renewed timer value.

Figure 7:
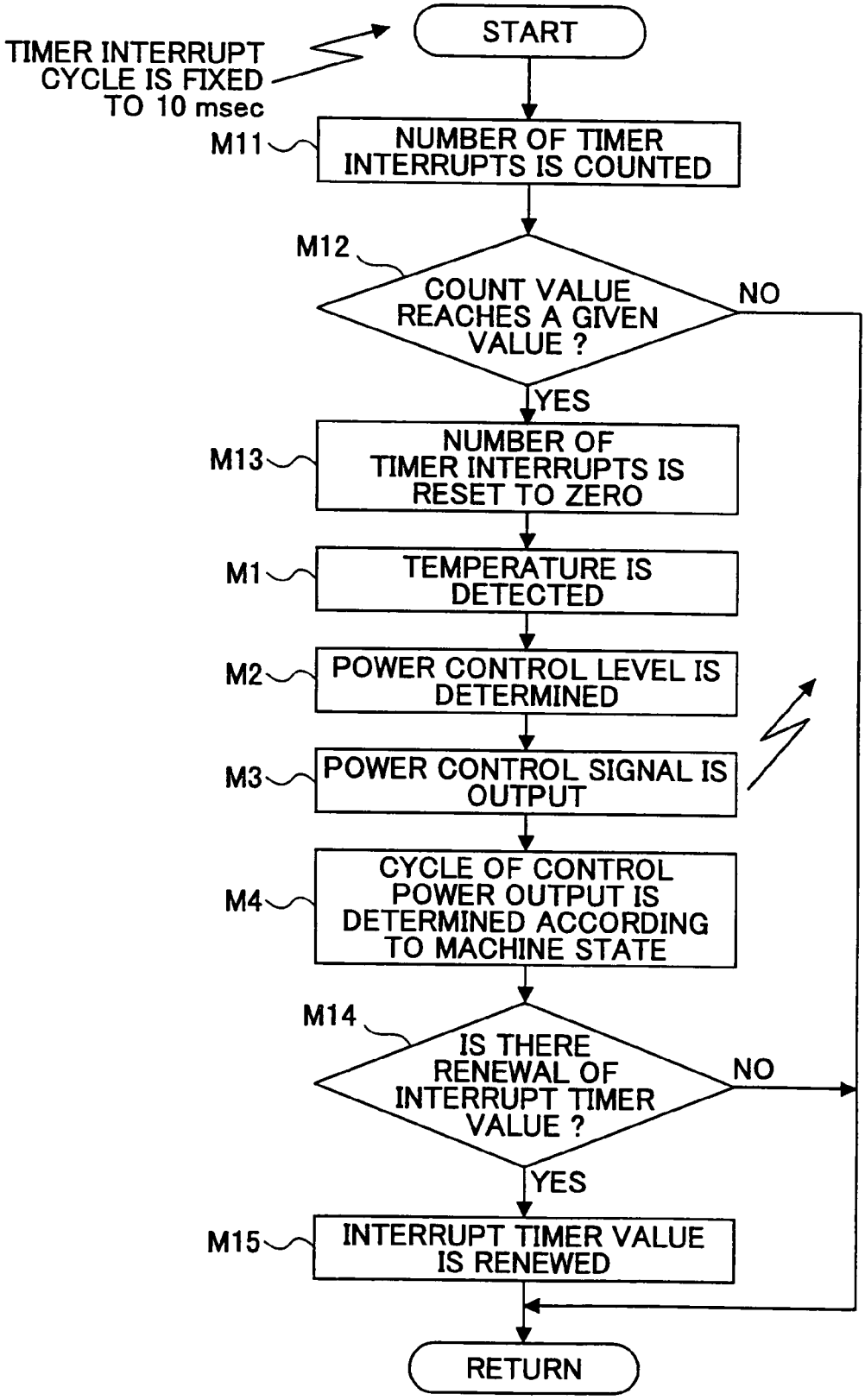
FIG. 7 is a flowchart of an example of the timer-interrupt fixed control operation to be performed by the main CPU.

FIG. 7 shows another example of a control operation to be performed by the main CPU 211. In this example, the timer interrupt cycle is fixed at 10 ms. When a timer interrupt occurs, the main CPU 211 counts the number of timer interrupts that have occurred in step M11, and determines whether the count value has reached a preset value in step M12. If the count value is smaller than the preset value ("NO" in step M12), a simple interrupt process is repeated. If the count value is equal to the preset value ("YES" in step M12), the main CPU 211 resets the count value to zero in step M13, and carries out the procedures of steps M1 through M3 shown in FIG. 5A as a present control operation. The main CPU 211 then determines the control cycle (the power control signal output cycle) in accordance with the state of the machine in step M4. This procedure is the same as the corresponding procedure shown in FIG. 6. If the interrupt timer value is to be renewed ("YES" in step M14), the main CPU 211 renews the interrupt timer value in step M15, and the operation returns to the temperature monitoring operation. After that, the temperature detecting procedure and the procedures that follow are repeated in the timer interrupt cycle determined by the original timer value or the renewed timer value.

Figure 8:
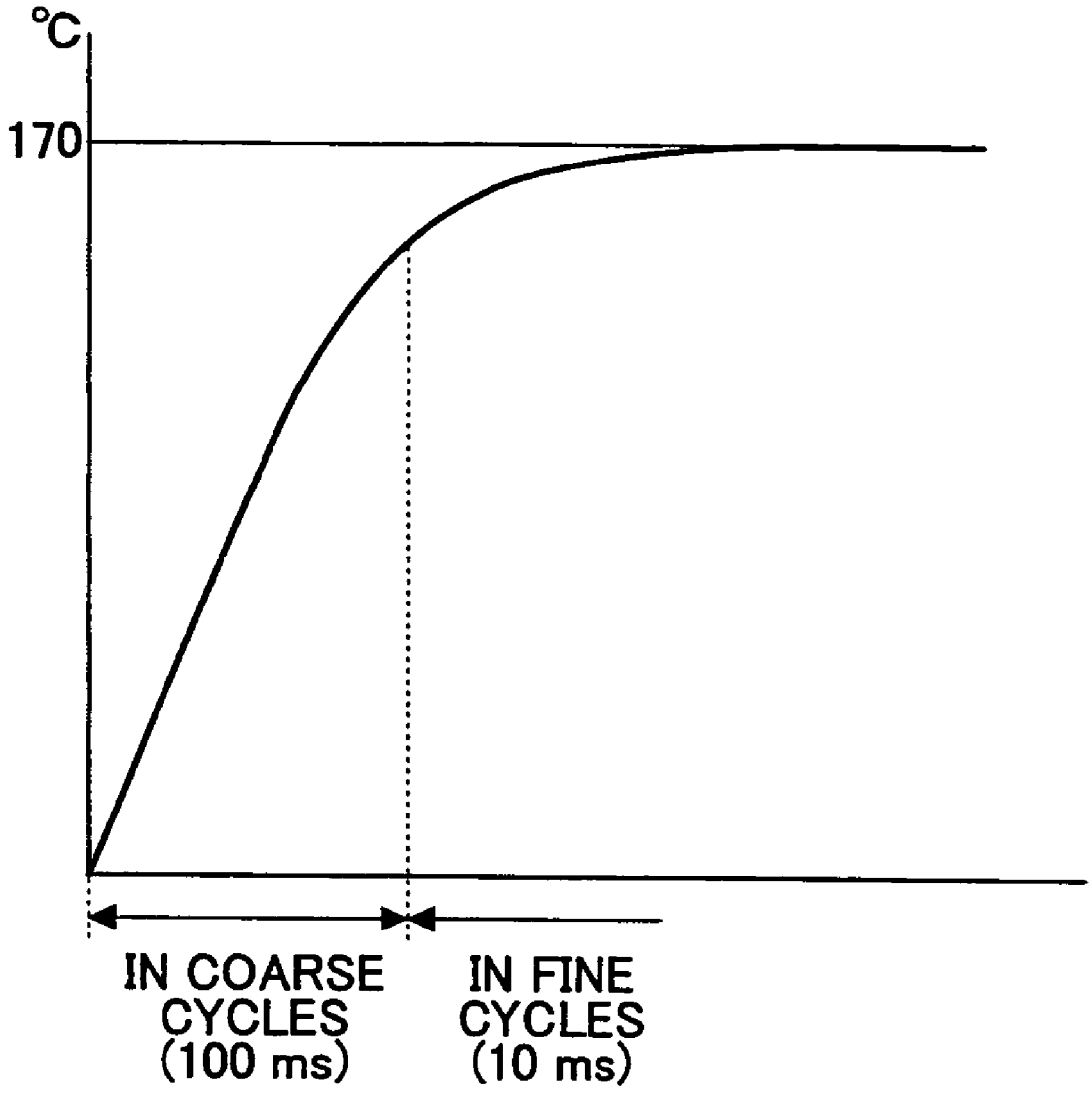
FIG. 8 shows the warm-up characteristics of the fixing device of the first embodiment.

As described above, the main CPU 211 periodically acquires the temperature of the fixing belt 204, and in accordance with the temperature, switches the output cycles of the power control signal to be transmitted to the IH CPU 215. By doing so, the main CPU 211 can perform power control in the "fine" cycle only in a temperature range that requires a fine control operation, while performing power control in the "coarse" cycle in a temperature range that does not require a fine control operation. Accordingly, the processing workload on the main CPU 211 is reduced. More specifically, when the detected temperature is close to the target temperature (170° C., for example), the main CPU 211 outputs the power control signal in a relatively "fine" cycle (at intervals of 10 ms, for example), as shown in FIG. 8. When the detected temperature is far from the target temperature, the main CPU 211 outputs the power control signal in a relative "coarse" cycle (at intervals of 100 ms, for example), as shown in FIG. 8. Accordingly, the workload on the main CPU 211 is greatly reduced. At the same time, the control power renewal cycle for the IH CPU 215 is variable at (control cycle)×n (n being an integer). Accordingly, IH fine control can be performed, while the workload on the main CPU 211 is reduced. Particularly, as the control power renewal cycle is made variable in accordance with the detected temperature, a fine IH control operation can be performed, while the control workload on the main CPU 211 is reduced.

Figure 9A:
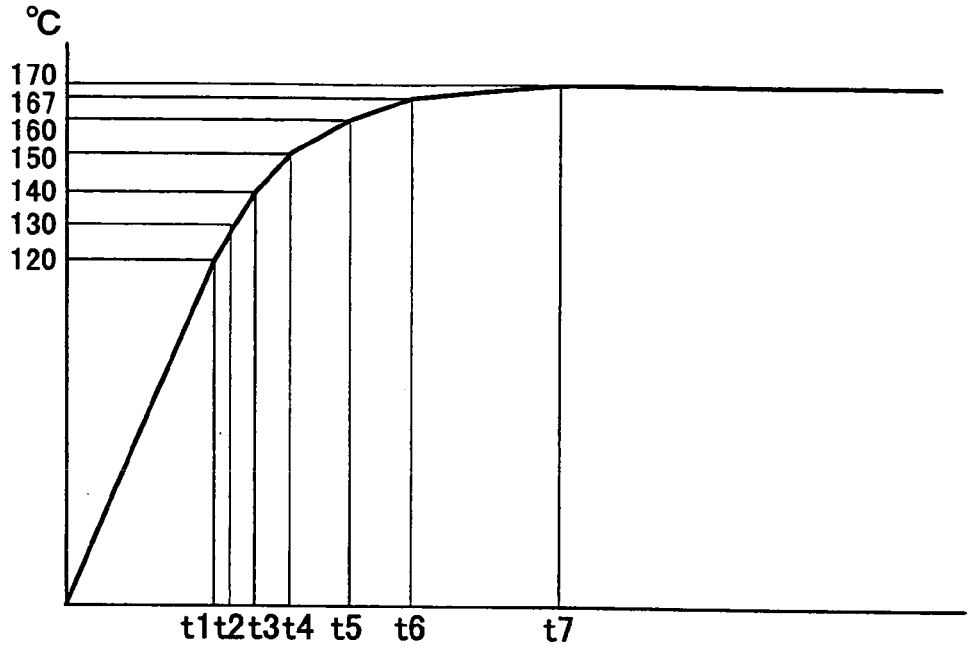
FIGS. 9A and 9B are characteristics charts showing the toner characteristics that are observed in different control operations.
Figure 9B:
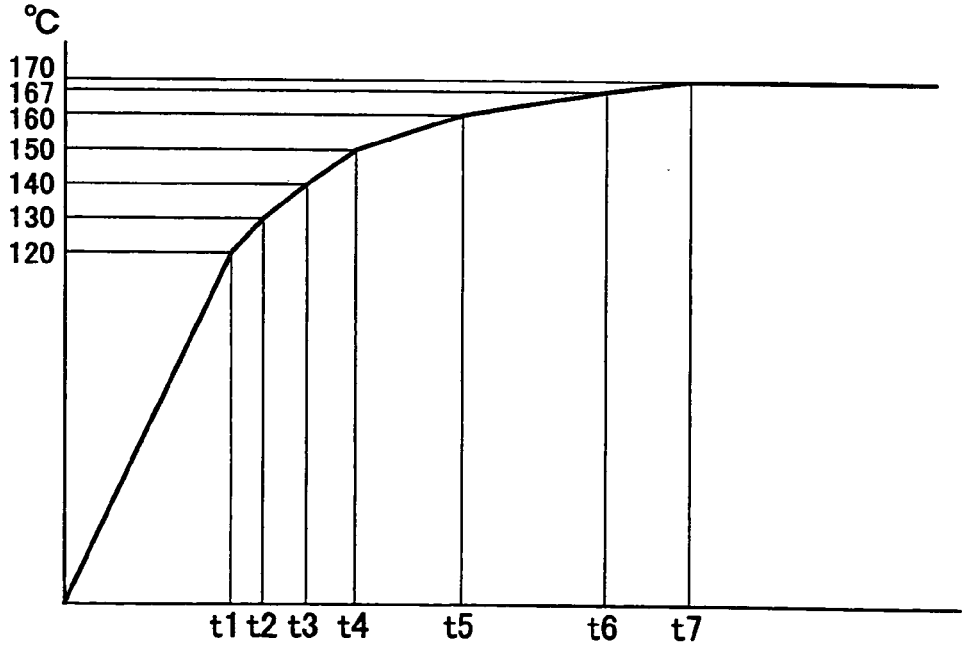

In image forming apparatuses of this type, the fixing characteristics such as toner characteristics (the warm-up characteristics, the temperature rise characteristics, and the fixing unit characteristics of the machine) vary with the type of machine. The output patterns of the power control signal to be output to the IH CPU 215 are set in the main CPU 211 in accordance with the fixing characteristics of each machine, so that a fine fixing control operation suitable for the fixing characteristics of the machine can be performed. Accordingly, the fixing starting time can be shortened depending on the state of the machine. In a case where a toner A with certain toner characteristics is used in a machine, such a power control signal pattern as to meet the warm-up characteristics shown in FIG. 9A should be set in the main CPU 211 in the machine. By doing so, the power control signal is changed at time t1 when the temperature reaches 120° C., the power control signal is changed at time t2 when the temperature reaches 130° C., and the same process is repeated in the control operation. Thus, a ripple is prevented in the fixing starting operation. In a case where a toner B with toner characteristics different from the toner A is used in a machine, such a power control signal pattern as to meet the start characteristics shown in FIG. 9B should be set in the main CPU 211. By doing so, the power control signal is changed at time t1 when the temperature reaches 120° C., the power control signal is changed at time t2 when the temperature reaches 130° C., and the same process is repeated in the control operation. Thus, a ripple is prevented in the fixing starting operation. In this manner, the power control signal is changed with the toner characteristics, so that the warm-up time can be shortened.

In the above control examples, when the detected temperature is close to the target temperature, temperature information is acquired in a relatively "fine" cycle, and a relatively minute power control signal is output. When the detected temperature is far from the target temperature, on the other hand, temperature information is acquired in a relatively "coarse" cycle, and a relatively rough power control signal is output. Thus, a fine IH control operation can be performed, while the workload on the main CPU 211 is reduced.

It is also possible to cause the main CPU 211 to set a target temperature in the IH CPU 215 in accordance with each situation. In that case, however, the IH CPU 215 needs to be designed to cope with different machines with different toner characteristics (fixing characteristics). In this aspect, the first embodiment of the present invention is advantageous, because only the power control signal is utilized. To cope with various types of machines, the power control signal patterns in the main CPU 211 are simply changed in this embodiment, and the IH CPU 215 can be used for any of the machines, without any special modification.

In this embodiment, the output cycles of the power control signal are switched between the "coarse"-cycle and the "fine" cycle in accordance with temperature information. However, it is also possible to provide a power control signal output cycle table (not shown) in a ROM or the like. This table contains different output cycles of the power control signal associated with temperature information. Referring to this table, the main CPU 211 can switch the output cycles of the power control signal to be output to the IH CPU 215 in accordance with acquired temperature information. Accordingly, the main CPU 211 can switch the output cycles not only between "coarse" and "fine", but also according to the table.

Figure 10:
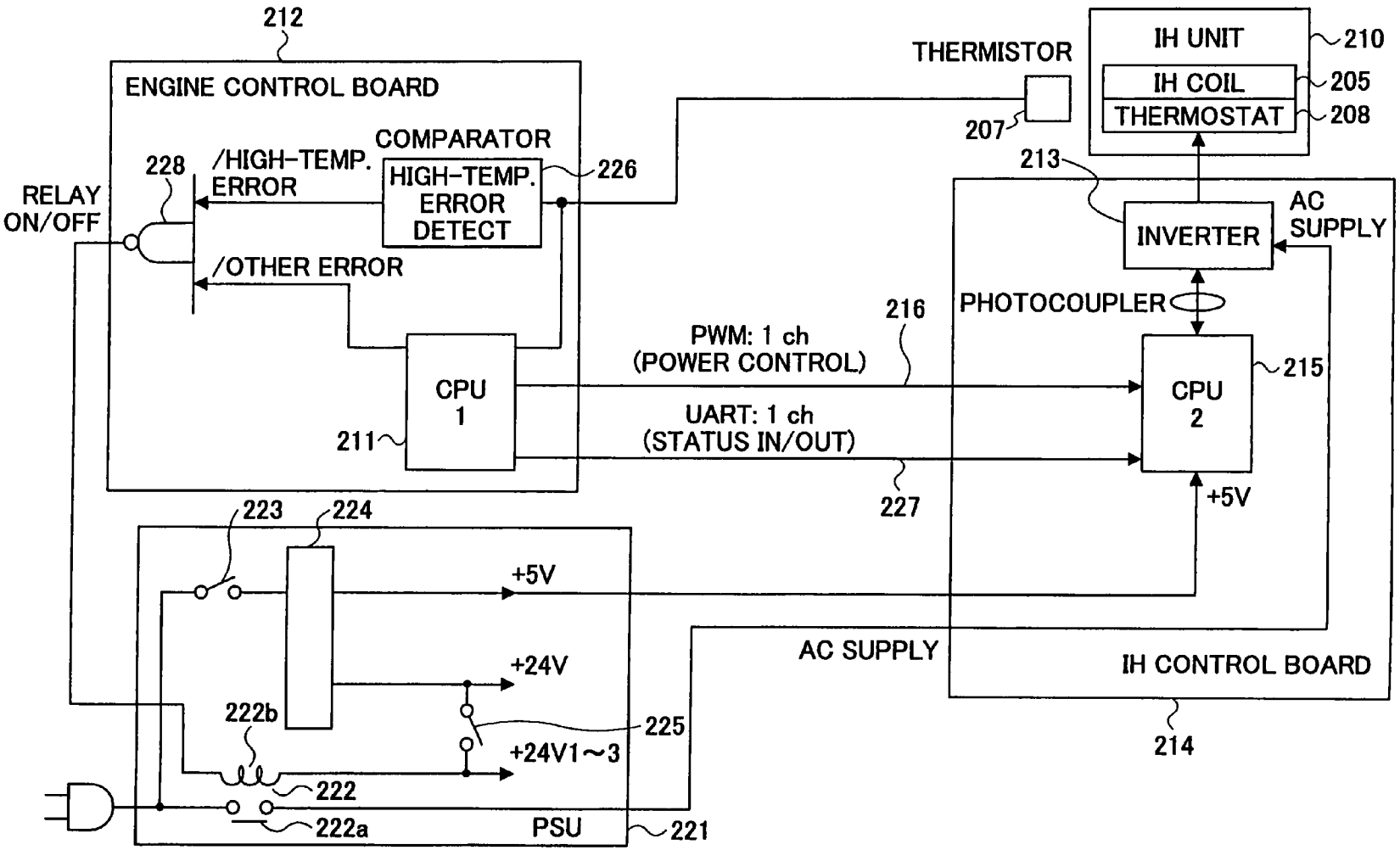
FIG. 10 is a block diagram schematically illustrating an example of the safety measure of the first embodiment.
Figure 11:
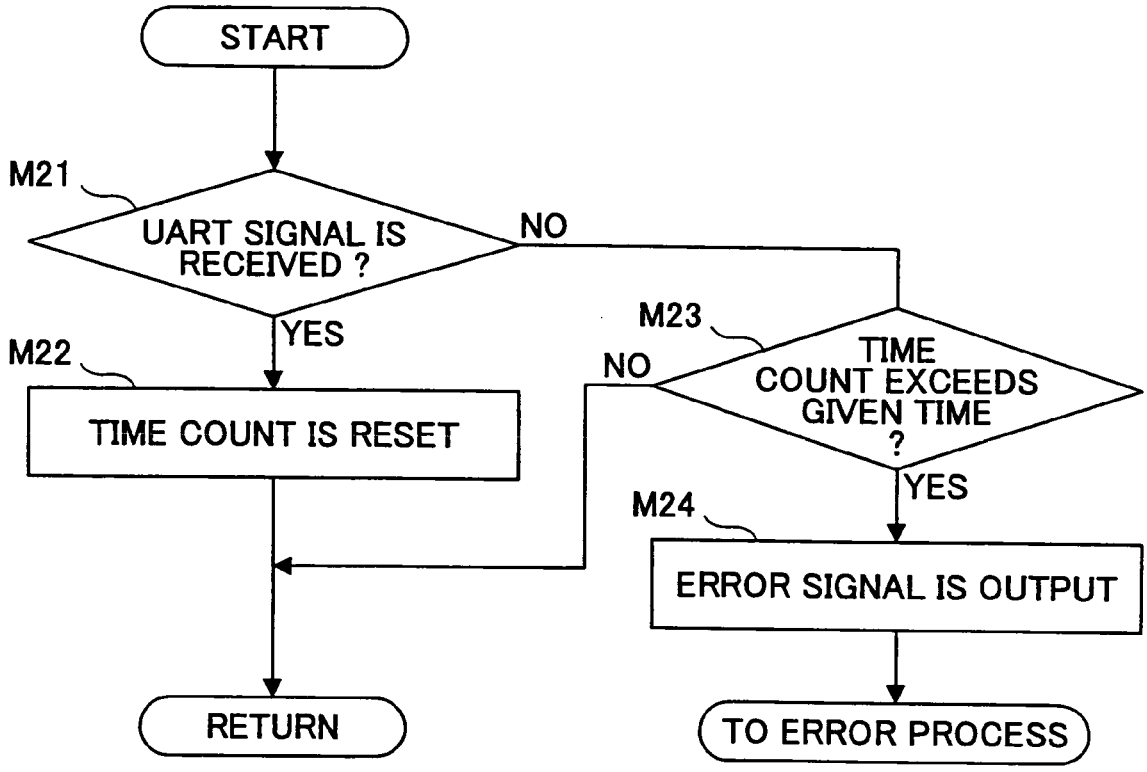
FIG. 11 is a flowchart of an example of the safety measure control operation of the first embodiment.

Referring now to FIGS. 10 and 11, a safety measure to be taken in this embodiment is described. The AC supply to the inverter circuit 213 for driving the IH coil 205 passes through a relay 222 in a power source unit (PSU) 221 provided in the image forming apparatus. Here, a DC power source 224 is provided with a main switch 223 in the PSU 221. The PSU 221 with the DC power source 224 is designed to provide a +5V power supply for the main CPU 211 and a +24 V power supply for a DC load. An interlock switch 225 is connected to the +24 V power supply line. When the front door of the image forming apparatus is opened, the interlock switch 225 cuts off the +24 V power supply for safety.

Meanwhile, a high-temperature error detecting circuit 226 is mounted on the engine control board 212. The high-temperature error detecting circuit 226 uses an analog comparator to compare a temperature signal supplied from the thermistor 207 with a reference signal corresponding to a preset reference temperature. The thermistor 207 detects the temperature of the fixing belt 204, as mentioned earlier. If the temperature signal represents a higher temperature than the reference temperature, the high-temperature error detecting circuit 226 outputs a high-temperature error signal to suspend the operation of the inverter circuit 213. The main CPU 211 and the IH CPU 215 are also connected to each other with a signal line 227 for intercommunication to transmit and receive various kinds of information. The main CPU 211 regularly receives a confirmation signal from the IH CPU 215 via the signal line 227. The confirmation signal indicates that the IH CPU 215 is operating properly. In accordance with the confirmation signal, the main CPU 211 detects a runaway condition in the IH CPU 215, and outputs an "other error" signal. An OR circuit 228 receives the high-temperature error signal from the high-temperature error detecting circuit 226 and the "other error" signal from the main CPU 211. A relay coil 222*b* for forcibly opening a closed relay contact 222*a* is connected to the output end of the OR circuit 228. When the high-temperature error signal or the other error signal is output, the relay coil 222*b* forcibly opens the relay contact 222*a*, so as to forcibly cut off the power supply to the inverter circuit 213.

In this structure, the main CPU 211 determines whether a UART signal is regularly received via the signal line 227, i.e., whether the confirmation signal is received from the IH CPU 215 in step M21, as shown in FIG. 11. If the confirmation signal is received ("YES" in step M21), the main CPU 211 determines that the IH CPU 215 is operating properly, and resets the time count in step M22. If the confirmation signal is not received ("NO" in step M21), the main CPU 211 determines whether the time count exceeds a predetermined time value in step M23. If the time count does not exceed the predetermined time value ("NO" in step M23), the main CPU 211 returns to the temperature monitoring operation. If the time count exceeds the predetermined time value ("YES" in step M23), the main CPU 211 outputs the "other error" signal to the OR circuit 228 in step M24. Upon receipt of the error signal, the OR circuit 228 forcibly opens the relay contact 222*a* via the relay coil 222*b*, so as to forcibly cut off the power supply to the inverter circuit 213. Thus, the current supply to the IH coil 205 is also cut off.

In the case where the relay contact 222*a* is opened as a temperature error is detected by the high-temperature error detecting circuit 226, or where the relay contact 222*a* is opened as a runaway condition in the IH CPU 215 is detected, the OR circuit 228 preferably outputs an error signal to the display unit on the operations panel (not shown) of the image forming apparatus, so that users can be informed of the error through an error message (or an error alarming beep) displayed on the display unit as an alarm unit. In this manner, an error is signaled by the alarm unit before the relay contact 222*a* is turned off due to a high-temperature error or a runaway condition caused in the IH CPU 215. Thus, users can take appropriate measures in the case of an error while maintaining safety of the power source.

As described above, the main CPU 211 of this embodiment constantly monitors the confirmation signal indicating that the IH CPU 215 is properly operating. If the confirmation signal is not transmitted over a certain period of time, the main CPU 211 directly and quickly detects a runaway condition in the IH CPU 215, and then turns off the relay contact 222*a*. By doing so, the current supply to the excitation coil 205 can be promptly cut off so as to maintain safety. Thus, higher reliability is achieved. Also, in a case where a temperature error is detected by the high-temperature error detecting circuit 226, the relay contact 222*a* is also forcibly turned off, regardless of the state of the IH CPU 215. Thus, safety can be maintained.

Second Embodiment

Next, a second embodiment of the present invention is described. In this embodiment, the same components as those of the first embodiment are denoted by the same reference numerals as in the first embodiment. Referring now to the block diagram shown in FIG. 12, an example structure of a control system for the IH coil unit 210 that includes the fixing belt 204, the excitation coil 205, and the thermistor 207 is described. The control system, i.e., the fixing controller, has the engine control board (the main control circuit) 212 on which the main CPU 211 is mounted. The main CPU 211 controls the entire image forming apparatus by performing control operations such as drive control for each driving source, peripheral equipment control, electrophotographic process control, and energy savings control, as well as the fixing control of this embodiment. A sensor signal generated from the thermistor 207 that detects the temperature of the fixing belt 204 is input to the main CPU 211. The sensor signal is analog-digital converted by the A-D converter of the main CPU 211, and is used to generate a temperature signal. With the temperature signal, temperature monitoring can be performed by the software. The sensor signal is also input to a high-temperature error detecting circuit 313 for detecting a high-temperature error in the fixing belt 204. The high-temperature error detecting circuit 313 is mounted on the engine control board 212, and detects a high-temperature error by the hardware, not depending on the main CPU 211. Here, the temperature software-monitored by the main CPU 211 is set lower than the temperature hardware-monitored by the high-temperature error detecting circuit 313. Accordingly, the fixing temperature is double-monitored, so that the circuit can be shut off even if a runaway condition occurs in the software. This shutting off process is described later in detail.

This control system also includes the IH control board (the induction-heating control circuit) 214 on which the inverter circuit 213 is mounted. The inverter circuit 213 functions as a power source for supplying current to the excitation coil 205 that inductively heats the fixing belt 204. After performing full wave rectification on the AC power supply, the inverter circuit 213 supplies a coil current to the excitation coil 205 and a capacitor (not shown). The coil current is a current that is high-frequency switched by a switching control device such as an IGBT or FET. With the coil current, resonance is caused, and an AC magnetic field is generated. Accordingly, the fixing belt 204 is heated with eddy current. The IH CPU 215 that serves as the sub central processing unit independent of the main CPU 211 is mounted on the IH control board 214. The IH CPU 215 is connected to the thermistor 207, and can receive temperature information of the fixing belt 204 from the thermistor 207. The IH CPU 215 receives only a temperature control signal transmitted as a control instruction from the main CPU 211 via a signal line 217. In accordance with the temperature control signal, the temperature information of the fixing belt 204, a sensed current signal, and a sensed voltage signal, the IH CPU 215 calculates a temperature control value for the inverter circuit 213, and outputs the temperature control value as an inverter control signal to the inverter circuit 213. This operation of the IH CPU 215 is referred to as the induction-heating control operation. The temperature control signal is basically used to provide the target temperature of the fixing belt 204 to the IH CPU 215. If the temperature control signal is provided in the form of a PWM signal, as is described later, a temperature control conversion value with switching duty is provided. If it is not necessary to change the target temperature frequently, a serial communication signal can be used, instead of a PWM signal. The inverter control signal is used to change the high-frequency switching duty in the inverter circuit 213. In accordance with the inverter control signal, the current flowing in the excitation coil 205 is changed so as to control the heating amount. In this manner, the IH CPU 215 of this embodiment performs both temperature control and power control in the induction-heating control operation. The temperature control is performed so that the temperature of the fixing belt 204 detected by the thermistor 207 becomes equal to the target temperature corresponding to the temperature control signal transmitted from the main CPU 211. In the temperature control operation, PI control can be used to achieve excellent temperature flexibility with respect to the target temperature with a smaller deviation. Meanwhile, the power control is performed to convert the temperature control value into a power control value, and the output value (an inverter control signal) of the power control is a PWM value. The inverter circuit 213 is controlled with the PWM signal, so that the amount of current flowing in the excitation coil 205 can be varied. The IH CPU 215 of this embodiment also has a software monitoring function that acquires the temperature of the fixing belt 204 through the thermistor 207, and suspends the operation of the inverter circuit 213 when there is an abnormal temperature rise. As the IH CPU 215 of this embodiment performs only the induction-heating control, a one-chip CPU that is less expensive and has a lower processing capacity than the main CPU 211 can be employed as the IH CPU 215. In such a case, the IH CPU 215 should preferably include an A-D converter, an interval timer, a serial communication UART, and an input/output unit, as well as a built-in ROM.

The IGBT used in the inverter circuit 213 is fragile, and therefore, it is necessary to constantly monitor the incoming current and incoming voltage, so as to prevent the IGBT from breaking down. The sensed current signal and the sensed voltage signal are used for this purpose, and are analog-digital converted by the A-D converter of the IH CPU 215. The converted signals are then processed in the IH CPU 215.

Figure 13A:
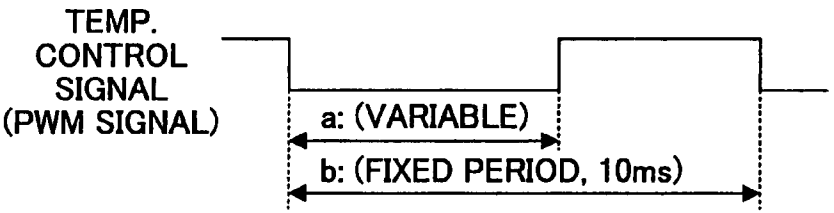
FIGS. 13A through 13D are timing charts showing examples of temperature control signals.
Figure 13B:
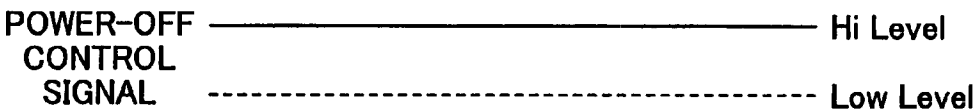
Figure 13C:
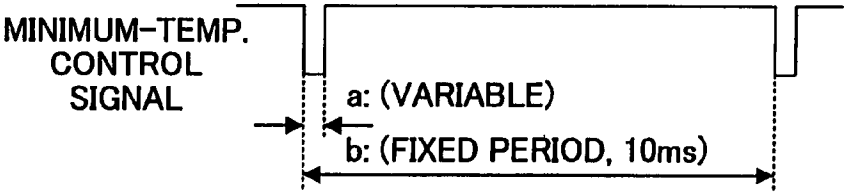
Figure 13D:
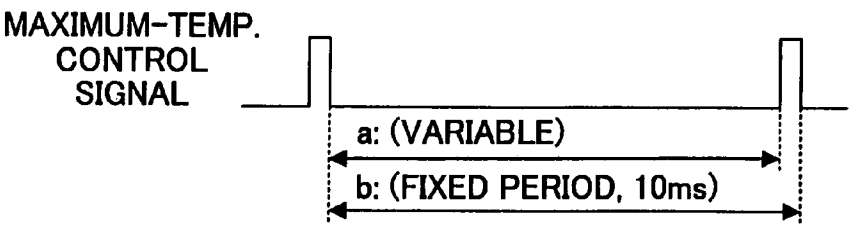

Referring now to the timing charts shown in FIGS. 13A through 13D, examples of the temperature control signal output from the main CPU 211 to the IH CPU 215 via the signal line 217 are described. In FIGS. 13A through 13D, a serial signal using a PWM (pulse width modulation) signal is shown. The main CPU 211 transmits a PWM signal to the IH CPU 215 at regular intervals of 10 ms, which is shorter than the control cycle (interrupt cycle) of the main CPU 211. The IH CPU 215 should be a CPU that can cope with the 10 ms resolution. In this case, the main CPU 211 does not renew the temperature control signal (or change the duty of the PWM signal) every 10 ms, but generates the temperature control signal at flexible intervals of 10 ms×n (n being an integer). In this embodiment, the temperature control is performed during the variable low-level period shown in FIG. 13A. Accordingly, when the power is turned off, the temperature control signal is fixed at high level as shown in FIG. 13B. When the low level period has the minimum width in the 10 ms period as shown in FIG. 13C, the temperature control signal represents the minimum temperature value. When the low level period has the maximum width in the 10 ms period as shown in FIG. 13D, the temperature control signal represents the maximum temperature value. The minimum width and the maximum width are determined in advance between the main CPU 211 and the IH CPU 215.

The temperature control signal is not limited to a serial signal (including a PWM signal), but may be a signal that represents a temperature control value through a combination of bits, such as "111" for 170° C., "110" for 160° C., and "101" for 150° C. In this manner, the temperature control value setting process can be further simplified.

Referring now to the flowcharts shown in

Figure 14A:
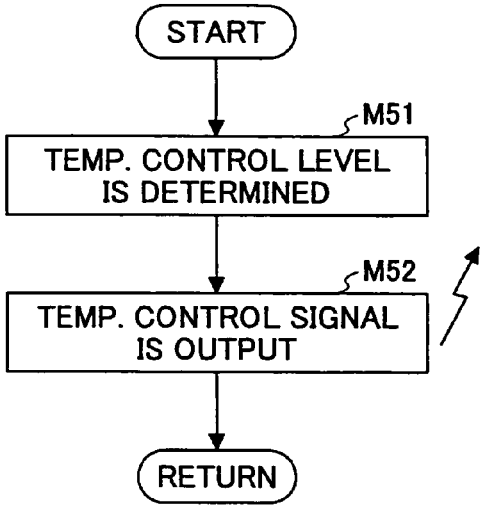
FIGS. 14A and 14B are flowcharts of an example of the fixing control operation of the second embodiment.
Figure 14B:
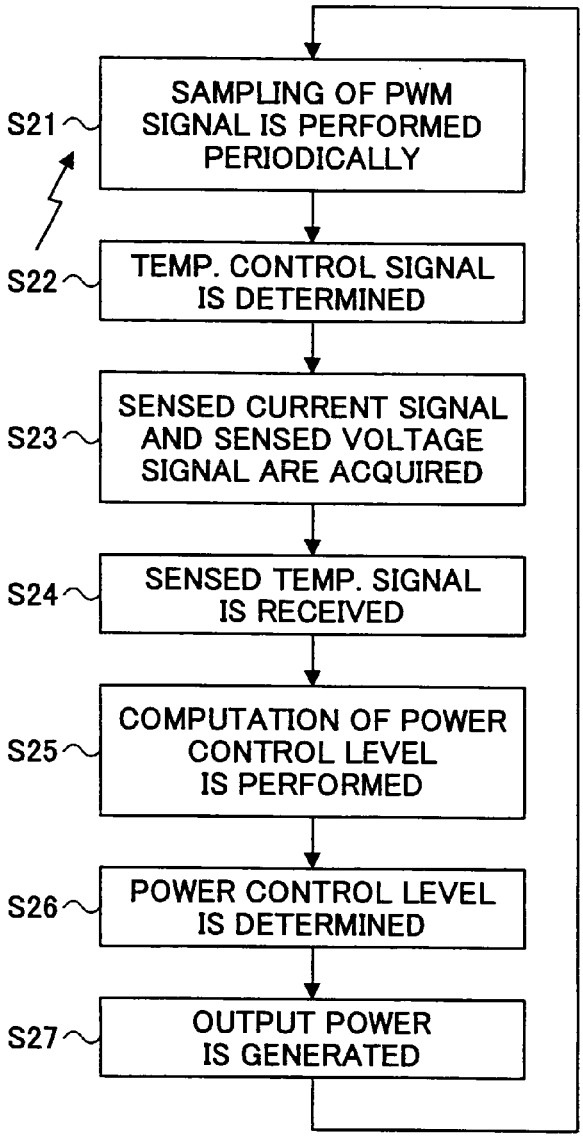

FIGS. 14A and 14B, an example of the fixing control operation is described. In the main routine shown in FIG. 14A, the main CPU 211 first determines the temperature control level (the target temperature) in step M51. The target temperature varies, depending on the image forming conditions, such as paper size, paper type, environmental temperature, color type (monochrome or full-color), and linear velocity. Therefore, the temperature control level should be determined, depending on the image forming conditions. In accordance with the determined temperature control level, the main CPU 211 determines the duty of the PWM signal, and outputs the duty as the temperature control signal to the IH CPU 215 via the signal line 217 in step M52.

Meanwhile, the IH CPU 215 periodically performs sampling of the control output as the PWM signal supplied from the main CPU 211 at intervals of 10 ms (the control cycle) in step S21, as shown in FIG. 14B. Through the sampling, the IH CPU 215 determines the temperature control signal in step S22. At the same time, the IH CPU 215 acquires a sensed current signal and a sensed voltage signal in step S23. The IH CPU 215 further acquires the temperature information of the fixing belt 204 through the thermistor 207 in step S24. The IH CPU 215 performs an arithmetic operation, based on the temperature control signal, the temperature information, the sensed current signal, and the sensed voltage signal in step S25. The IH CPU 215 then determines the power control level for the inverter circuit 213 through PI control or the like, so that the detected temperature becomes equal to the temperature control level (the target temperature) in step S26. In accordance with the power control level, the IH CPU 215 generates output power level in step S27. More specifically, the IH CPU 215 outputs a PWM signal to the inverter circuit 213, so as to vary the amount of current flowing in the excitation coil 205 in accordance with the target value.

As described above, this embodiment utilizes the induction-heating fixing technique and the 2-CPU fixing technique, so that the main CPU 211 that controls the entire image forming apparatus only needs to output the temperature control signal as a control instruction to the IH CPU 215. Accordingly, the control workload on the main CPU 211 can be reduced, and the corresponding control software can be prevented from becoming complicated. Also, a fine control operation can be performed, taking advantage of the excellent temperature flexibility that is naturally obtained by the induction-heating fixing technique. Particularly, the main CPU 211 only needs to output the target temperature as the temperature control signal, while the IH CPU 215 controls and maintains the temperature. Accordingly, the control workload on the main CPU 211 can be greatly reduced. The temperature control signal is output as a PWM signal (representing the temperature with its duty), and the PWM output is maintained until the main CPU 211 renews the PWM value by an interval timer function provided in the main CPU 211. Accordingly, the IH CPU 215 can monitor the temperature control information at regular intervals, and the main CPU 211 can change the PWM value at irregular intervals. In this aspect, the workload on the main CPU 211 can also be reduced. Further, the main CPU 211 outputs the target temperature as the temperature control signal, and the IH CPU 215 that performs the actual power control monitors the temperature directly through the thermistor 207. In accordance with the monitored temperature, the IH CPU 215 performs the induction-heating control operation to control the power in such a manner that the optimum output can be constantly obtained from the excitation coil 205. Thus, a fine induction-heating control operation can be constantly performed in accordance with the state of the machine, the target temperature corresponding to the selected image mode, and the detected temperature. Through such a fine induction-heating operation, higher image quality can be achieved.

In this embodiment, the main CPU 211 does not need to output the temperature control signal to the IH CPU 215 in the control cycle (at intervals of 10 ms) of the IH CPU 215. Since the IH CPU 215 automatically adjusts the power control value until the controlled temperature becomes equal to the target temperature, the temperature control signal needs to be output only once.

Figures 15, 16:
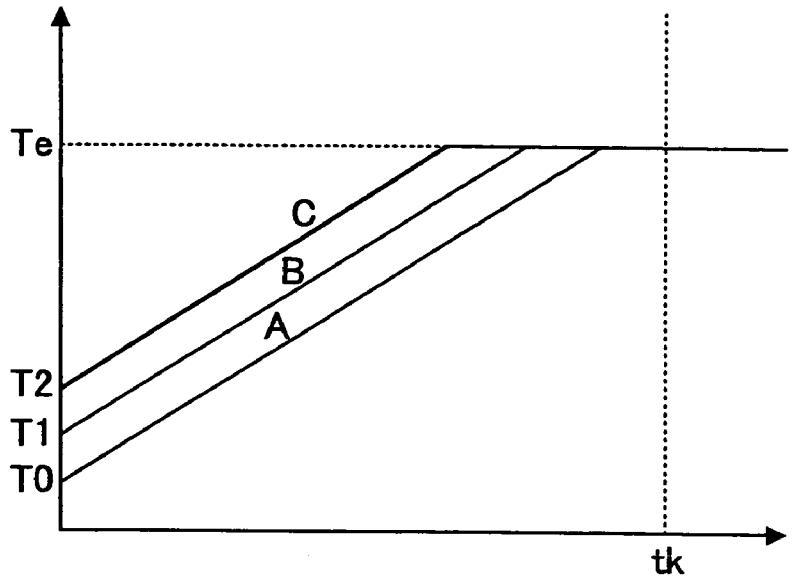
FIG. 15 shows characteristics curves representing the fixing temperature rises that are observed where the temperature control signal is not changed during the operation.
FIG. 16 shows an example of the table for defining the primary control temperature.

The raising time of the fixing temperature varies with the temperature of the fixing belt 204 at the starting time (at the start of current supply). FIG. 15 shows raising characteristics A, B, and C that are obtained when the value of an ultimate target temperature Te is output as the value of the temperature control signal, with the temperature of the fixing belt 204 at the starting time being T0, T1, and T2. As can be seen from FIG. 5, the time required to reach the target temperature Te varies among A, B, and C. As the temperature at the starting time is higher, the controlled temperature reaches the target temperature Te more quickly.

However, there is no point in raising the fixing temperature before the other units are activated. Therefore, the value of the temperature control signal may be changed during the process of raising the fixing temperature. In this case, the value of the temperature control signal is at first made smaller than the value of the target temperature, depending on the temperature at the starting time. The value of the temperature control signal is then made equal to the value of the target temperature in the end. In this manner, the warm-up time can be made constant, regardless of the difference in temperature at the starting time, and unnecessary power consumption can be reduced. This control operation can be realized because the workload on the main CPU 211 in the temperature control operation is very small.

Figure 17:
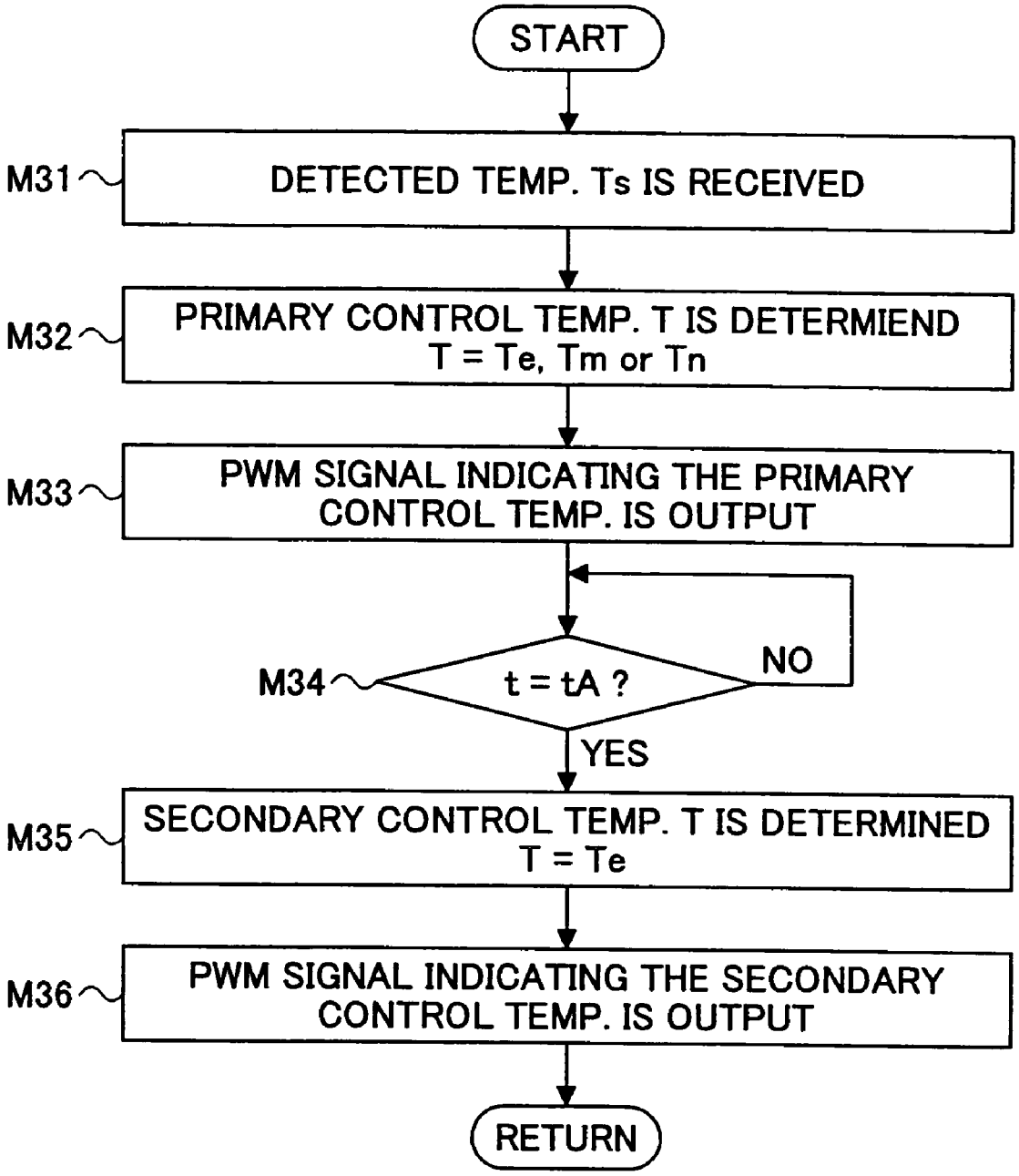
FIG. 17 is a flowchart of an example of the control operation in which the temperature control signal is changed during the operation.
Figure 18:
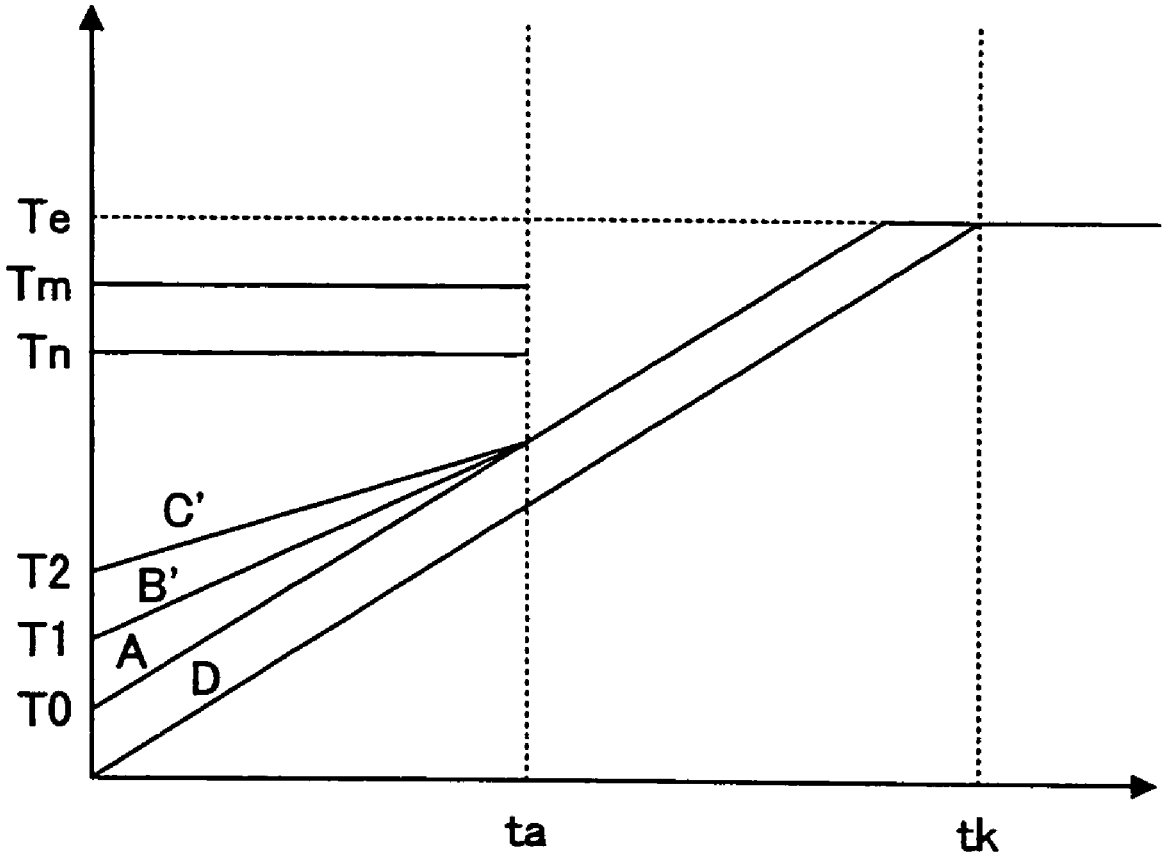
FIG. 18 shows characteristics curves representing the fixing temperature rises that are observed where the temperature control signal is changed during the operation.

Referring now to FIGS. 16 through 18, an example of the above described control operation is described. In this example, the values of the temperature control signal are switched between a primary control temperature and a secondary control temperature. A table 250 that defines the relationship between a detected temperature and the primary temperature, as shown in FIG. 16, is prepared and stored in the ROM in the main CPU 211, with the raising characteristics of the fixing temperature shown in FIG. 18 being taken into consideration with respect to each machine.

At the start of current supply, the main CPU 211 first acquires a detected temperature Ts of the fixing belt 204 from the thermistor 207 in step M31. In accordance with the detected temperature Ts at the starting time, the main CPU 211 refers to the table 250, and determines the primary control temperature T to be Te, Tm, or Tn in step M32. The main CPU 211 then outputs a PWM signal indicating the determined primary control temperature T in step M33. In accordance with the PWM signal, the IH CPU 215 performs the control operation shown in FIG. 14B. Meanwhile, the main CPU 211 stands by until a predetermined time ta passes in step M34. After the predetermined time ta has passed ("YES" in step M34), the main CPU 211 determines the secondary control temperature T to be the ultimate target temperature Te in step M35. The main CPU 211 then outputs a PWM signal indicating the secondary control temperature T (=Te) to the IH CPU 215 in step M36. In accordance with the PWM signal, the IH CPU 215 performs the control operation shown in FIG. 14B.

FIG. 18 shows the raising characteristics of the fixing temperature that are observed in the control operation shown in FIGS. 16 and 17. The primary control temperature is determined from the table 250, and is output as the temperature control signal. By doing so, the time required to reach the target temperature, i.e., the raising time of the fixing temperature, can be made constant, regardless of the difference in temperature at the starting time. For example, in the case where the temperature of the fixing belt 204 at the starting time is T2, the primary control temperature is set at a relatively low temperature Tn, so that the temperature raising characteristics exhibit a gentle slope, as indicated by C' in FIG. 18. After the time ta has passed, the secondary control temperature is switched to Te, which is the ultimate target temperature. As a result, the time required to reach the ultimate target temperature Te becomes equal to the time required in the case where the temperature of the fixing belt 204 at the starting time is T0. The same applies to the case where the temperature of the fixing belt 204 at the starting time is T1.

As described above, when the temperature of the fixing belt 204 at the start of current supply is higher than a predetermined reference temperature, and more time can be allowed for the warm-up time, the value of the temperature control signal should be set at a lower value (Tm or Tn) than the target temperature value Te. In this manner, unnecessary power consumption can be reduced. If the temperature of the fixing belt 204 acquired from the thermistor 207 at the start of current supply is high, the value of the temperature control signal should be set at a lower value than the target temperature value Te. From another point of view, a temperature control signal that is different from the temperature control signal indicating the target temperature should be output, so that the warm-up time of the fixing belt 204 becomes constant. For the above control operation, this embodiment provides the table 250 that defines the relationship between the temperature control signal value and the temperature information obtained at the start of current supply. In accordance with the temperature information obtained at the start of current supply, the main CPU 211 of this embodiment refers to the table 250, and changes the value of the temperature control signal to be output to the IH CPU 215. Thus, the main CPU 211 can readily output a suitable temperature control signal, according to the table 250.

Figure 19:
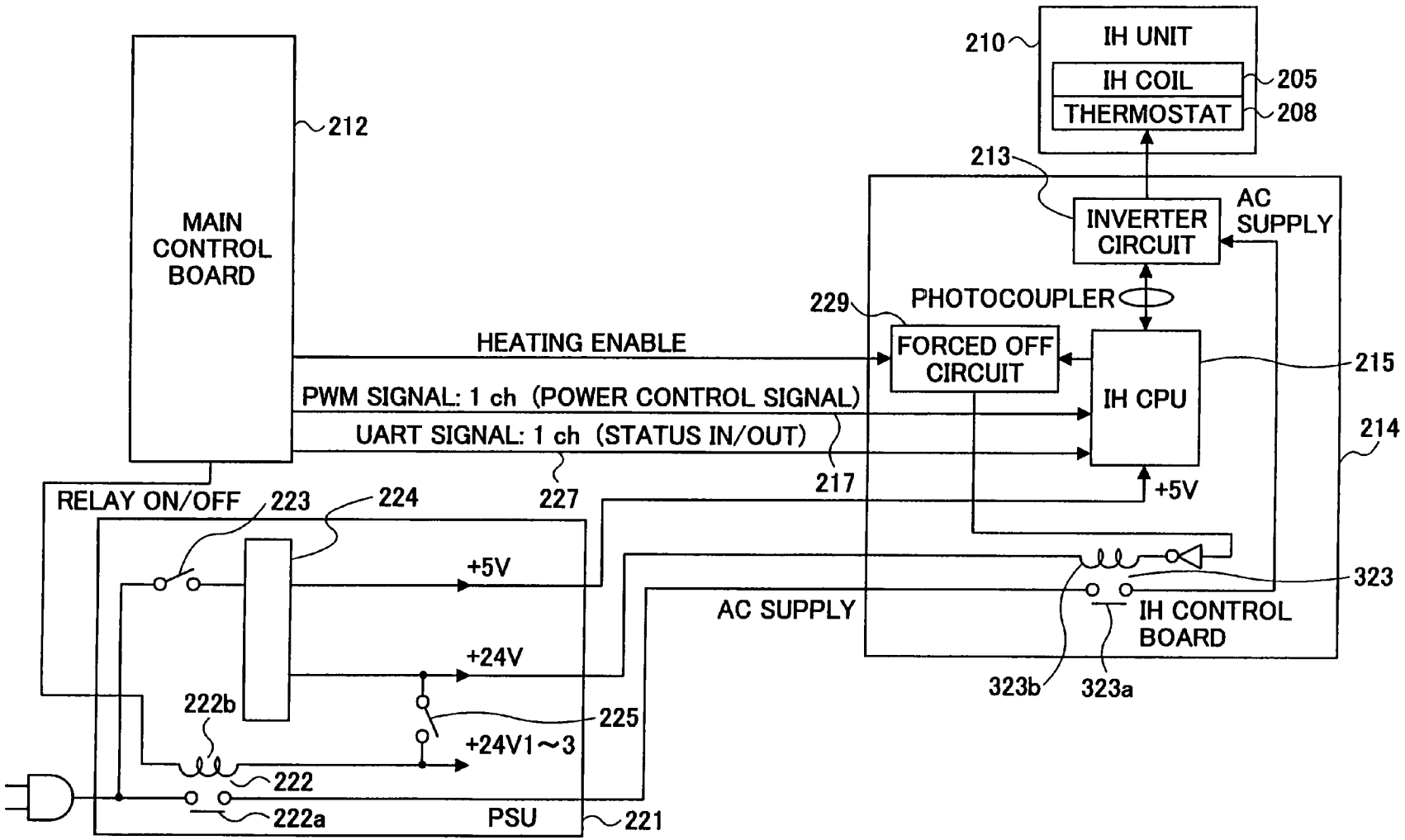
FIG. 19 is a block diagram schematically illustrating an example of the safety measure of the second embodiment.
Figure 20:
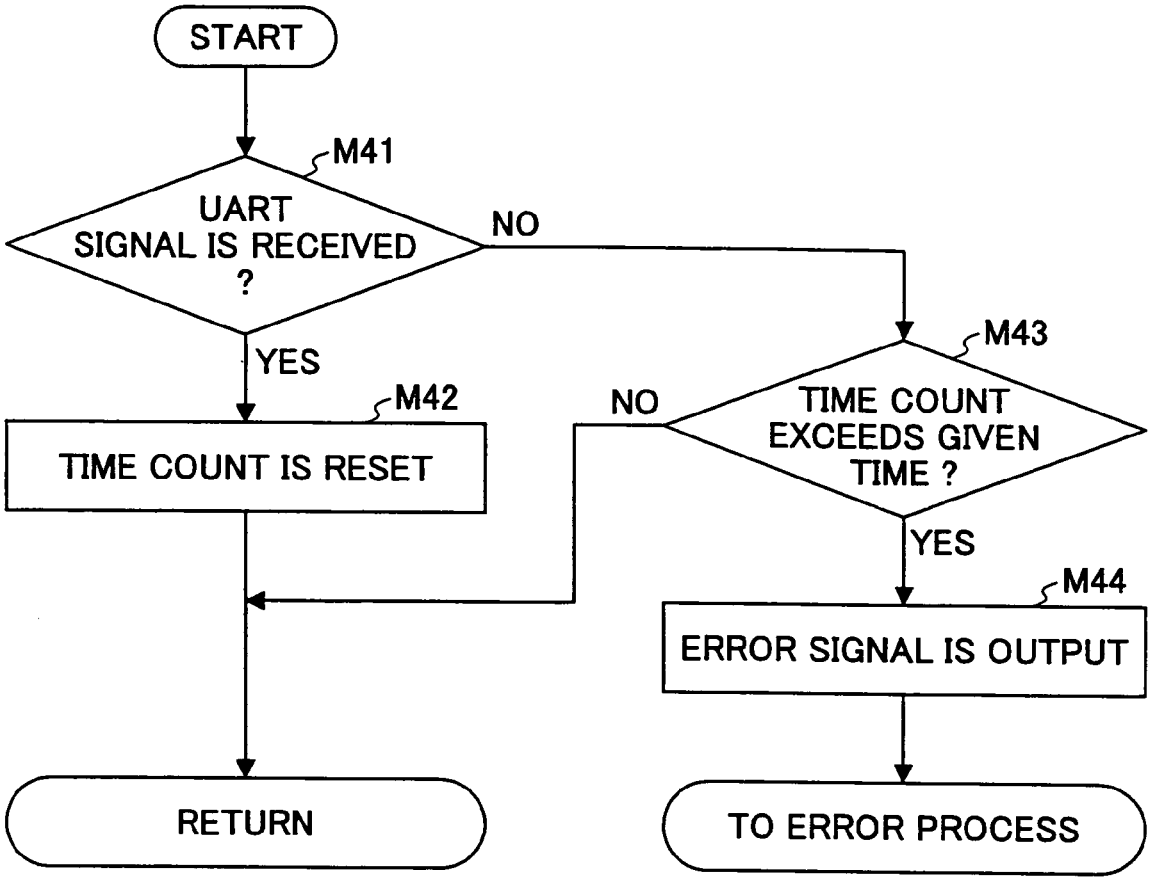
FIG. 20 is a flowchart of an example of the safety measure control operation of the second embodiment.

Referring now to FIGS. 19 and 20, the safety measure to be taken in this embodiment is described. The AC supply to the inverter circuit 213 for driving the IH coil 205 is designed to pass through the relay contact 222*a* of the relay 222 of the power source unit (PSU) 221 provided in the image forming apparatus, and a relay contact 323*a* of a relay 323 mounted on the IH control board 214. The closed relay contact 222*a* is forcibly opened by the relay coil 222*b* that is energized when an OFF signal is output as a relay ON/OFF signal from the main CPU 211 mounted on the engine control board 212. Here, the DC power source 224 is provided with the main switch 223 in the PSU 221. The PSU 221 with the DC power source 224 is designed to provide a +5 V power supply for the main CPU 221 and a +24 V power supply for a DC load. The interlock switch 225 is connected to the +24 V power supply line. When the front door of the image forming apparatus is opened, the interlock switch 225 cuts off the +24 V power supply for safety.

Figure 12:
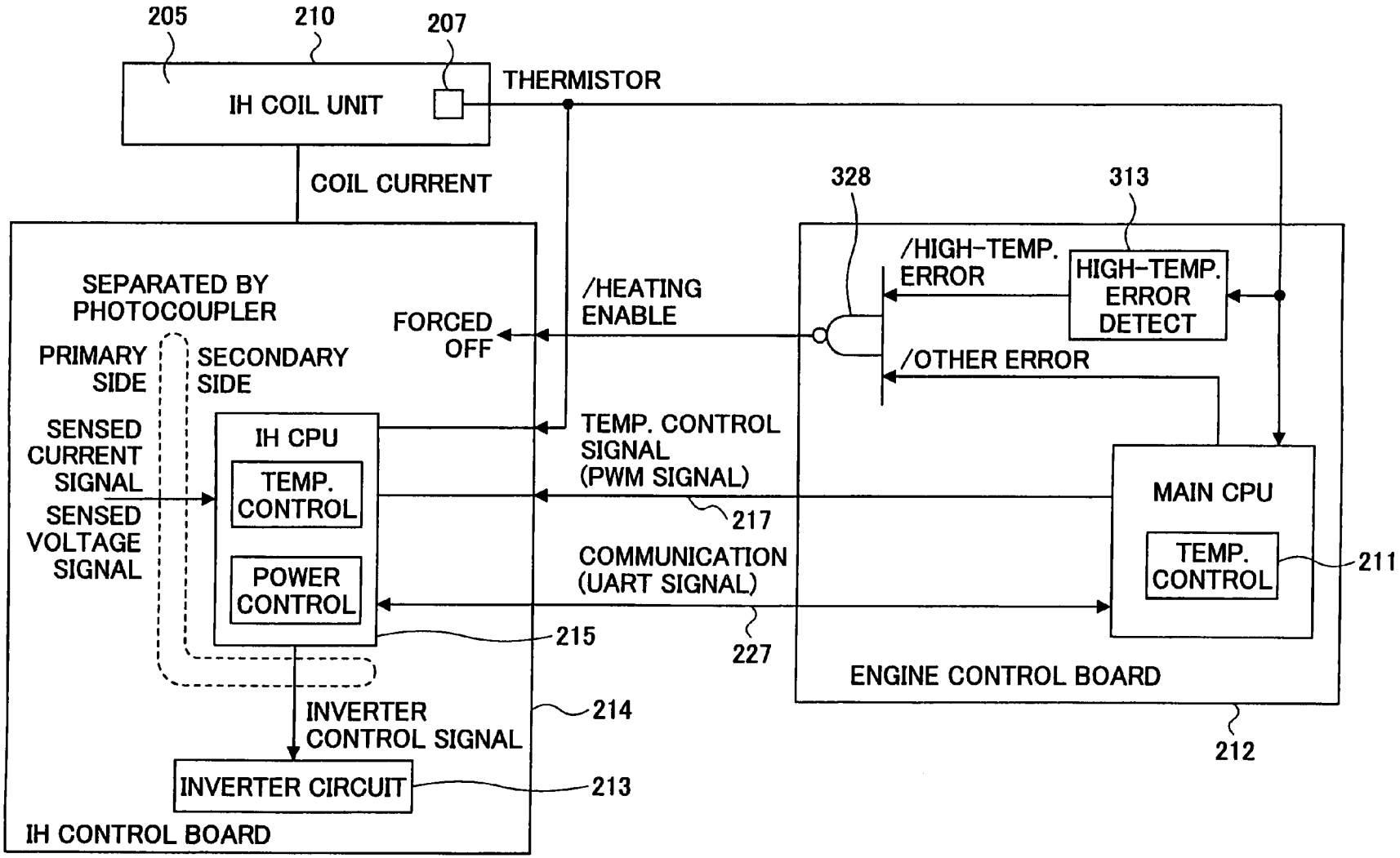
FIG. 12 is a block diagram schematically illustrating the structure of a fixing controller of a second embodiment of the present invention.

Meanwhile, the high-temperature error detecting circuit 313 is mounted on the engine control board 212 as shown in FIG. 12. The high-temperature error detecting-circuit 313 uses an analog comparator to compare a temperature signal supplied from the thermistor 207 with the reference signal corresponding to the preset reference temperature. The thermistor 207 detects the temperature of the fixing belt 204, as described earlier. If the temperature signal represents a higher temperature than the reference temperature, the high-temperature error detecting circuit 313 outputs a high-temperature error signal to suspend the operation of the inverter circuit 213. The main CPU 211 and the IH CPU 215 are also connected to each other with the signal line 227 for intercommunication to transmit and receive various kinds of information. The main CPU 211 regularly receives a confirmation signal as a status signal from the IH CPU 215 via the signal line 227. The confirmation signal indicates that the IH CPU 215 is operating properly. In accordance with the confirmation signal, the main CPU 211 detects a runaway condition in the IH CPU 215, and outputs an "other error" signal. An OR circuit 328 (FIG. 12) receives the high-temperature error signal from the high-temperature error detecting circuit 313, and the "other error" signal from the main CPU 211. The output of the OR circuit 328 is transmitted as a heating enable signal to a forced OFF circuit 229 mounted on the IH control board 214, as shown in FIG. 19. The forced OFF circuit 229 receives the heating enable signal, and then outputs a cut-off signal. A relay coil 323*b* for forcibly opening the closed relay contact 323*a* is connected to the output end of the forced OFF circuit 229. When the high-temperature error signal or the "other error" signal is output from the OR circuit 328, the relay coil 323*b* forcibly opens the relay contact 323*a*, so as to forcibly cut off the power supply to the inverter circuit 213.

In this structure, the main CPU 211 determines whether a UART signal is regularly received via the signal line 227, i.e., whether the confirmation signal is received from the IH CPU 215 in step M41, as shown in FIG. 20. If the confirmation signal is received ("YES" in step M41), the main CPU 211 determines that the IH CPU 215 is operating properly, and resets the time count in step M42. If the confirmation signal is not received ("NO" in step M41), the main CPU 211 determines whether the time count exceeds a predetermined time value in step M43. If the time count does not exceed the predetermined time value ("NO" in step M43), the main CPU 211 returns to the temperature detecting operation. If the time count exceeds the predetermined time value ("YES" in step M43), the main CPU 211 outputs the "other error" signal to the OR circuit 328 in step M44. Upon receipt of the error signal, the OR circuit 328 outputs the heating enable signal to the forced OFF circuit 229. The forced OFF circuit 229 then forcibly opens the relay contact 323*a* via the relay coil 323*b*, so as to forcibly cut off the power supply to the inverter circuit 213. Thus, the current supply to the IH coil 205 is also cut off.

In the case where the IH CPU 215 that constantly monitors the temperature detected through the thermistor 207 detects a high-temperature error (a lower temperature than the temperature detected by the high-temperature error detecting circuit 313), or where the IH CPU 215 cannot communicate with the main CPU 211 and an error is also detected in the main CPU 211, the forced OFF circuit 229 forcibly opens the relay contact 323*a* via the relay coil 323*b* in accordance with the error signal transmitted from the IH CPU 215, so as to forcibly cut off the power supply to the inverter circuit 213. Thus, the current supply to the IH coil 205 is also cut off.

In the case where the relay contact 323*a* is opened as a temperature error is detected by the high-temperature error detecting circuit 313, or where the relay contact 323*a* is opened as a runaway condition in the IH CPU 215 is detected, an error signal from the OR circuit 328 (or a cut-off signal from the forced OFF circuit 229) should preferably be output to the display unit on the operations panel (not shown) of the image forming apparatus, so that users can be informed of the error through an error message (or an error alarming beep) displayed on the display unit as an alarm unit. In this manner, an error is reported by the alarm unit, before the relay contact 323*a* is turned off due to a high-temperature error or a runaway condition caused in the IH CPU 215. Thus, users can take appropriate measures in the case of an error, while maintaining safety of the power source.

As described above, the main CPU 211 of this embodiment constantly monitors the confirmation signal indicating that the IH CPU 215 is operating properly. If the confirmation signal is not transmitted over a certain period of time, the main CPU 211 directly and quickly detects a runaway condition in the IH CPU 215, and then turns off the relay contact 323*a*. By doing so, the current supply to the excitation coil 205 can be promptly cut off, so as to maintain safety. Thus, higher reliability is achieved. Also, in a case where a temperature error is detected by the high-temperature error detecting circuit 313, the relay contact 323*a* is also forcibly turned off, regardless of the state of the IH CPU 215. Thus, safety can be maintained. It is to be noted that the present invention is not limited to the embodiments specifically disclosed above, but other variations and modifications may be made without departing from the scope of the invention.

This patent application is based on Japanese Priority Patent Applications Nos. 2003-299618 filed and 2003-299617 both filed on Aug. 25, 2003 and 2004-183474, filed on Jun. 22, 2004, the entire contents of which are hereby incorporated by reference.

What is claimed is:

1. A fixing controller comprising:

a main control circuit that includes a main central processing unit configured to control all operations of an image forming apparatus;

a temperature sensor configured to detect a temperature of a fixing member;

an excitation coil configured to receive a current supply and inductively heat the fixing member; and an induction-heating control circuit that includes a sub central processing unit independent of the main central processing unit and that is configured to control current supplied to the excitation coil, wherein the main central processing unit is configured to send a desired power signal as a control instruction to the sub central processing unit, based on the temperature detected by the temperature sensor, the sub central processing unit is configured to control current flowing in the excitation coil based on the desired power signal sent by the main central processing unit, a sensed voltage, and a sensed current, and the main central processing unit periodically acquires the temperature of the fixing member detected by the temperature sensor, and, in accordance with the temperature, switches output control cycles of the desired power signal sent to the sub central processing unit, when the temperature acquired is close to a target temperature, the main central processing unit outputs the desired power signal in a short control cycle, and, when the temperature acquired is far from the target temperature, the main central processing unit outputs the desired power signal in a long control cycle, which is longer in duration than the short control cycle.

2. The fixing controller as claimed in claim 1, wherein the sub central processing unit has a lower processing capacity than the main central processing unit.

3. The fixing controller as claimed in claim 1, wherein the desired power signal sent from the main central processing unit is a serial signal.

4. The fixing controller as claimed in claim 3, wherein the serial signal is a PWM signal with a predetermined cycle.

5. The fixing controller as claimed in claim 1, wherein the desired power signal sent from the main central processing unit represents a power control level through a combination of bits.

6. The fixing controller as claimed in claim 1, wherein the main central processing unit periodically acquires the temperature of the fixing member detected by the temperature sensor, and, in accordance with the temperature acquired, periodically outputs a target temperature signal to the sub central processing unit.

7. The fixing controller as claimed in claim 1, wherein the main central processing unit has desired power signal patterns preset therein, the patterns varying with fixing characteristics of each of a plurality of the image forming apparatuses.

8. The fixing controller as claimed in claim 7, wherein the fixing characteristics are toner characteristics of each of the image forming apparatuses.

9. The fixing controller as claimed in claim 8, wherein the toner characteristics include warm-up characteristics, temperature rising characteristics, and fixing unit characteristics of each of the image forming apparatuses.

10. The fixing controller as claimed in claim 1, wherein the sub central processing unit has a shorter control cycle for the desired power signal than the main central processing unit.

11. The fixing controller as claimed in claim 10, wherein the main central processing unit renews the desired power signal to be output to the sub central processing unit at flexible intervals of "control cycle" ×n (n being an integer).

12. The fixing controller as claimed in claim 11, wherein the main central processing unit arbitrarily sets the renewal cycle of the desired power signal to be output to the sub central processing unit, in accordance with the temperature acquired from the temperature sensor.

13. The fixing controller as claimed in claim 1, further comprising:

a high-temperature error detecting circuit that detects a high-temperature error in the heated fixing member, based on the temperature acquired from the temperature sensor; and a relay that is provided in a current supply path leading to the excitation coil, and is switched on and off by the high-temperature error detecting circuit;

wherein the high-temperature error detecting circuit switches off the relay so as to cut off the current supply to the excitation coil, when a high-temperature error is detected in the heated fixing member.

14. The fixing controller as claimed in claim 13, further comprising:

an alarm unit that signals an error, when the relay is switched off.

15. A fixing controller comprising:

a main control circuit that includes a main central processing unit configured to control all operations of an image forming apparatus;

a temperature sensor configured to detect a temperature of a fixing member;

an excitation coil configured to receive a current supply and inductively heat the fixing member; and an induction-heating control circuit that includes a sub central processing unit independent of the main central processing unit and that is configured to control current supplied to the excitation coil, wherein the main central processing unit is configured to send a desired power signal as a control instruction to the sub central processing unit, based on the temperature detected by the temperature sensor, the sub central processing unit is configured to control current flowing in the excitation coil based on the desired power signal sent by the main central processing unit, a sensed voltage, and a sensed current, the main central processing unit periodically acquires the temperature of the fixing member detected by the temperature sensor, and, in accordance with the temperature, switches output control cycles of the desired power signal sent to the sub central processing unit, and when the temperature acquired is close to a target temperature, the main central processing unit acquires the temperature from the temperature sensor in a relatively short control cycle and outputs a relatively minute desired power signal, and, when the temperature acquired is far from the target temperature, the main central processing unit acquires a temperature from the temperature sensor in a relatively long cycle, which is longer in duration than the short cycle, and outputs a relatively rough desired power signal.

16. A fixing controller comprising:

a main control circuit that includes a main central processing unit configured to control all operations of an image forming apparatus;

a temperature sensor configured to detect a temperature of a fixing member;

an excitation coil configured to receive a current supply and inductively heat the fixing member; and an induction-heating control circuit that includes a sub central processing unit independent of the main central processing unit and that is configured to control current supplied to the excitation coil, wherein the main central processing unit is configured to send a desired power signal as a control instruction to the sub central processing unit, based on the temperature detected by the temperature sensor, and the sub central processing unit is configured to control current flowing in the excitation coil based on the desired power signal sent by the main central processing unit, a sensed voltage, and a sensed current, and the main central processing unit periodically acquires the temperature of the fixing member detected by the temperature sensor, and, in accordance with the temperature, switches output control cycles of the desired power signal sent to the sub central processing unit, further comprising a table that defines output control cycles of the desired power signal to be output to the sub central processing unit, each of the output control cycles being associated with a temperature, wherein the main central processing unit refers to the table in accordance with the temperature acquired, and then switches the output control cycles of the desired power signal to be output to the sub central processing unit.

17. A fixing controller comprising:

a main control circuit that includes a main central processing unit configured to control all operations of an image forming apparatus;

a temperature sensor configured to detect a temperature of a fixing member;

an excitation coil configured to receive a current supply and inductively heat the fixing member; and an induction-heating control circuit that includes a sub central processing unit independent of the main central processing unit and that is configured to control current supplied to the excitation coil, wherein the main central processing unit is configured to send a desired power signal as a control instruction to the sub central processing unit, based on the temperature detected by the temperature sensor, and the sub central processing unit is configured to control current flowing in the excitation coil based on the desired power signal sent by the main central processing unit, a sensed voltage, and a sensed current, further comprising, a relay that is provided in a current-supply path leading to the excitation coil, and is switched on and off by the main central processing unit;

wherein the main central processing unit switches off the relay so as to cut off the current supply to the excitation coil, when a confirmation signal indicating that the sub central processing unit is operating properly is not transmitted from the sub central processing unit over a predetermined period of time.

18. An image forming apparatus comprising:

a printer engine that includes a fixing device equipped with a fixing member configured to be inductively heated, a photosensitive member, and other electrophotographic processing members; and a fixing controller configured to control the fixing member, including:

a main control circuit that includes a main central processing unit configured to control all operations of an image forming apparatus;

a temperature sensor configured to detect a temperature of the fixing member;

an excitation coil configured to receive a current supply and inductively heat the fixing member; and an induction-heating control circuit that includes a sub central processing unit independent of the main central processing unit and that is configured to control current supplied to the excitation coil, wherein the main central processing unit is configured to send a desired power signal as a control instruction to the sub central processing unit, based on the temperature detected by the temperature sensor, the sub central processing unit is configured to control current flowing in the excitation coil based on the desired power signal sent by the main central processing unit, a sensed voltage, and a sensed current, the main central processing unit periodically acquires the temperature of the fixing member detected by the temperature sensor, and, in accordance with the temperature, switches output control cycles of the desired power signal sent to the sub central processing unit, and, when the temperature acquired is close to a target temperature, the main central processing unit outputs the desired power signal in a short control cycle, and, when the temperature acquired is far from the target temperature, the main central processing unit outputs the desired power signal in a long control cycle, which is longer in duration than the short control cycle.

19. A fixing control method utilizing a fixing controller that includes a main control circuit that includes a main central processing unit configured to control all operations of an image forming apparatus the method comprising:

providing a temperature sensor configured to detect a temperature of a heated fixing member;

providing an excitation coil that configured to receive a current supply and inductively heat the fixing member;

providing an induction-heating control circuit that includes a sub central processing unit independent of the main central processing unit and that is configured to control the current supply to the excitation coil, wherein the main central processing unit periodically acquires the temperature of the fixing member detected by the temperature sensor, and, in accordance with the temperature, switches output control cycles of the desired power signal sent to the sub central processing unit, and when the temperature acquired is close to a target temperature, the main central processing unit outputs the desired power signal in a short control cycle, and, when the temperature acquired is far from the target temperature, the main central processing unit outputs the desired power signal in a long control cycle, which is longer in duration than the short control cycle, the method further comprising outputting a desired power signal as a control instruction to the sub central processing unit based on the temperature detected by the temperature sensor; and calculating a current level to send to the excitation coil based on the desired power signal sent from the main central processing unit, a sensed current of the excitation coil, and a sensed supply voltage, the calculated current level being used to control current driving the excitation coil.

* * * * *